US010967477B2

(12) United States Patent
Jessup et al.

(10) Patent No.: US 10,967,477 B2
(45) Date of Patent: Apr. 6, 2021

(54) SURFACE TREATING APPARATUS

(71) Applicant: Atomic Energy of Canada Limited / Energie Atomique du Canada Limitee, Deep River (CA)

(72) Inventors: Howard Jessup, Pembroke (CA); Fabrice M. Guerout, Deep River (CA)

(73) Assignee: Atomic Energy Of Canada Limited / Energie Atomique Du Canada Limitee, Chalk River (CA)

( * ) Notice: Subject to any disclaimer, the term of this patent is extended or adjusted under 35 U.S.C. 154(b) by 448 days.

(21) Appl. No.: 16/070,135

(22) PCT Filed: Jan. 13, 2017

(86) PCT No.: PCT/CA2017/050043
§ 371 (c)(1),
(2) Date: Jul. 13, 2018

(87) PCT Pub. No.: WO2017/120679
PCT Pub. Date: Jul. 20, 2017

(65) Prior Publication Data

US 2019/0022819 A1 Jan. 24, 2019

Related U.S. Application Data

(60) Provisional application No. 62/279,288, filed on Jan. 15, 2016.

(51) Int. Cl.
*B24B 33/02* (2006.01)
*B24B 33/08* (2006.01)

(52) U.S. Cl.
CPC ..... *B24B 33/025* (2013.01); *B24B 33/02* (2013.01); *B24B 33/08* (2013.01); *B24B 33/081* (2013.01); *B24B 33/082* (2013.01)

(58) Field of Classification Search
CPC ..... B24B 33/025; B24B 33/02; B24B 33/08; B24B 33/081; B24B 33/082
USPC ..... 451/51, 61, 120
See application file for complete search history.

(56) References Cited

U.S. PATENT DOCUMENTS 2,465,422 A 3/1949 Henry
2,694,278 A * 11/1954 Anderson ..... B24B 23/08 451/440
2,694,884 A 11/1954 Peden
(Continued)

OTHER PUBLICATIONS

Extended European search report in EP 17738067.2 dated Jun. 6, 2019.

(Continued)

*Primary Examiner* — George B Nguyen
(74) *Attorney, Agent, or Firm* — Kevin Shipley; Fogler, Rubinoff LLP

(57) ABSTRACT

A surface treating apparatus for treating an inner surface of a bore containing a shaft may include a body connectable to a drive apparatus and configured to movably receive a shaft extending through a bore, and at least one surface treating member connected to and movable with the body relative to the shaft, the at least one surface treating member sized to be inserted within an annular gap formed between the shaft and an inner surface of the bore and to bear against the inner surface of the bore when the shaft is received by the body.

20 Claims, 19 Drawing Sheets

(56) References Cited

U.S. PATENT DOCUMENTS

| | | | | | |
|---|---|---|---|---|---|
| 2,845,751 | A * | 8/1958 | Woodward | B24B 7/075 | 451/120 |
| 3,065,579 | A | 11/1962 | Clark | | |
| 3,713,256 | A | 1/1973 | Besenbrunch et al. | | |
| 4,328,647 | A | 5/1982 | Gillette et al. | | |
| 4,615,152 | A | 10/1986 | Bogaerts | | |
| 4,980,996 | A * | 1/1991 | Klink | B24B 29/08 | 29/888.06 |
| 5,709,591 | A * | 1/1998 | Warner | B24B 33/08 | 451/180 |
| 6,179,718 | B1 * | 1/2001 | Morath | B21K 1/44 | 408/13 |
| 6,910,945 | B2 * | 6/2005 | Suzuki | B24B 33/02 | 451/120 |
| 2003/0054743 | A1 | 3/2003 | Negley | | |
| 2014/0113535 | A1 | 4/2014 | Baumgartner et al. | | |

OTHER PUBLICATIONS

ISR/WO issued on corresponding PCT/CA2017/050043 dated Mar. 13, 2017.

* cited by examiner

SURFACE TREATING APPARATUS

CROSS-REFERENCE TO RELATED APPLICATIONS

This application claims the benefit of 35 USC 119 based on the priority of co-pending U.S. Provisional Patent Application 62/279,288, filed Jan. 15, 2016 and entitled Surface Treating Apparatus, which is incorporated herein in its entirety by reference.

FIELD

The present subject matter of the teachings described herein relates generally to a surface treating apparatus, such as a grinding or honing tool, for treating a surface.

BACKGROUND

US 2014/0113535 discloses a honing tool for machining cylindrical bores has a tool body provided with a guide bore and a feed rod disposed in the guide bore. The tool body has a honing stone receptacle extending from the guide bore in a radial direction of the tool body outwardly through the tool body. A honing stone is arranged in the honing stone receptacle. A pin is disposed in the honing stone and projects laterally from the honing stone. An elongate spring is disposed in the tool body parallel to the honing stone, wherein the elongate spring element has a first end section, a central section, and a second end section opposite the first end section. The central section is guided across the pin and the first end section is secured in the radial direction in the tool body.

U.S. Pat. No. 4,328,647 discloses a honing tool for machining cylindrical bores has a tool body provided with a guide bore and a feed rod disposed in the guide bore. The tool body has a honing stone receptacle extending from the guide bore in a radial direction of the tool body outwardly through the tool body. A honing stone is arranged in the honing stone receptacle. A pin is disposed in the honing stone and projects laterally from the honing stone. An elongate spring is disposed in the tool body parallel to the honing stone, wherein the elongate spring element has a first end section, a central section, and a second end section opposite the first end section. The central section is guided across the pin and the first end section is secured in the radial direction in the tool body.

U.S. Pat. No. 3,065,579 discloses a cylinder honing tool for use in a conventional electric drill which will be self-centering and self-bottoming and which can be quickly slipped into a cylinder of any size and which will automatically, resiliently and uniformly expand to accurately maintain honing elements against the wall of the selected cylinder regardless of the internal diameter of the latter.

U.S. Pat. No. 2,694,884 discloses a honing tool especially adapted for small diameter bores, which overcomes these problems by allowing the simultaneous finishing of the entire length of surface, and by providing means for feeding the abrasive stone radially outwardly during the operation.

SUMMARY

This summary is intended to introduce the reader to the more detailed description that follows and not to limit or define any claimed or as yet unclaimed invention. One or more inventions may reside in any combination or subcombination of the elements or process steps disclosed in any part of this document including its claims and figures.

In accordance with one aspect of the teachings disclosed herein, a surface treating apparatus for treating an inner surface of a bore containing a shaft can include a body connectable to a drive apparatus and configured to movably receive a shaft extending through the bore. At least one surface treating member can be connected to and movable with the body relative to the shaft. The at least one surface treating member may be sized to be inserted within an annular gap formed between the shaft and an inner surface of the bore and to bear against the inner surface of the bore when the shaft is received by the body.

The body may be configurable to laterally receive the shaft.

The body may include a collar having a collar aperture extending along a collar axis and sized to movably receive the shaft.

The collar may be configurable between a closed configuration, in which the aperture completely encircles the shaft, and an open position, in which the aperture is open to laterally receive the shaft.

The collar may include at least a first base portion and a second base portion that is detachably connected to the first base portion. Detaching the second base portion from the first base portion may help open the aperture to laterally receive the shaft.

The collar aperture may have a diameter in a lateral direction that is generally orthogonal to the collar axis and a thickness of the surface treating member in the lateral direction may be between about 5% and 30% of the diameter.

The apparatus may also include at least one support member connected to the body and having a first end that is axially spaced apart from the body and is positionable within the annular gap formed between the shaft and the inner surface of the bore, and wherein the at least one surface treating member is mounted to the first end of the at least one support member.

The body may have a body axis and when the shaft is received by the body the body axis is parallel to the shaft and the first end of the support member may be biased laterally outwardly away from the body axis.

The first end of the support member may include a first finger, a second finger spaced apart from the first finger around a perimeter of the body and the surface treating pad may be disposed between and is movable relative to the first finger and second finger.

The apparatus may include a surface treating member support pivotally coupled to the first end of the support member. The surface treating member may be mounted to the pad support.

The surface treating member support may pivot about a pivot axis that intersects the surface treating member and the first and second fingers.

The support member may include a second end axially spaced apart from the first end and may be pivotally connected to body by a pivot joint that may be disposed axially between the first end and second end of the support member.

A biasing member may engage the second end and biasing the second end laterally inwardly, whereby the first end may be urged laterally outwardly.

The at least one support member may include first, and second support arms coupled to the body and spaced apart from each other around a perimeter of the body.

The biasing member may include a spring that extends around a perimeter of the body and engages the second end of each of the first and second support arms.

The at least one support member may include first, second, third and fourth support arms coupled to the body and spaced apart from each other around a perimeter of the body, and each comprising respective first ends, second ends and pivot joints.

A drive apparatus may be connectable to the body and may include a rotary drive to rotate the body about a body axis, whereby the body rotates about the shaft and the surface treating member may be moved across the inner surface of the bore.

The drive apparatus may include an axial drive to translate the body, the at least one support arm and the surface treating pad axially along the body axis relative to the shaft.

The axial drive and rotary drive may be operable simultaneously with each other.

The surface treating member may have a thickness in a radial/lateral direction that is less than about 5 mm.

A protective sleeve may extend axially along the body axis and may have a central aperture to movably receive the shaft. The protective sleeve may be positionable laterally between the shaft and the surface treating member to prevent contact between the surface treating member and the shaft and being rotatable with the surface treating member relative to the shaft.

A suction apparatus may have a nozzle fluidly connected to a suction source and may be positionable proximate the surface treating member to extract from the bore debris generated by engagement between the surface treating member and the inner surface of the bore.

The nozzle may be configurable in a closed configuration, in which it can encircle the shaft, and an open configuration, in which it can laterally receive the shaft.

In accordance with another aspect of the teachings disclosed herein, which may be used alone or in combination with any other aspects, a method of honing an inner surface of a bore in a valve body while a valve stem extends through the bore, may include the steps of:

a) positioning a body of a honing tool relative to a valve stem so that the body can move relative to the valve stem, the body extending along a body axis that is aligned with the valve stem;

b) inserting a surface treating member into an annular gap formed between an outer surface of the valve stem and an inner surface of a bore, the surface treating member connected to the body;

c) pressing the surface treating member against the inner surface of the bore; and d) moving the body relative to the valve stem and the inner surface of the bore, whereby the surface treating member travels across the inner surface of the bore to hone the inner surface of the bore.

Step a) may include laterally positioning the body around the shaft.

The method may include opening the body to laterally receive the valve stem and closing the body around the valve stem.

The method may include biasing the surface treating member against the inner surface of the bore using a biasing member.

The method may include a support member coupled to the body and having a distal end axially spaced apart from the body and comprising the surface treating member.

The support arm may include a proximal end axially spaced apart from the distal end and a pivot coupling connected to the body and disposed axially between the proximal and distal ends, and wherein a biasing member biases the proximal end inwardly toward the body axis thereby urging the distal end outwardly away from the body axis.

The method may include rotating the body about a body axis and relative to the valve stem using a driving apparatus coupled to the body.

The driving apparatus may include a mounting member that is non-rotatably attached to the valve stem to support the drive apparatus and the body may be rotatable relative to the mounting member.

The method may include translating the body axially along the body axis whereby the surface treating member moves axially across the inner surface of the bore.

The method may include simultaneously rotating the body about the body axis and translating the body about the body axis.

Steps a)-d) may be performed without detaching the valve from adjacent structures.

Steps a)-d) may be performed while maintaining a radial gap between the surface treating member and the outer surface of the valve stem while the surface treating member travels across the inner surface of the bore.

The method may include positioning a protective sleeve laterally between the surface treating member and at least a portion of the outer surface of the valve stem to prevent contact between the surface treating member and the outer surface of the valve stem, the protective sleeve being coupled to and rotatable with the body about the body axis.

The method may also include removing packing material from within the annular gap formed between the outer surface of the valve stem and the inner surface of the bore before inserting the surface treating member into the annular gap.

Removing the packing material may include:

a) positioning a cutting tool body relative to the valve stem so that the body can move relative to the valve stem about a cutting body axis, the cutting tool may include cutting teeth to cut the packing materials;

b) inserting cutting teeth into the annular gap formed between the outer surface of the valve stem and the inner surface of the bore;

c) rotating the cutting teeth about the cutting body axis relative to the valve stem and axially translating the cutting teeth relative to the valve stem toward the packing material and into the annular gap so that the cutting teeth engage and cut at least a portion of the packing material; and d) axially withdrawing the cutting teeth out of the annular gap.

In accordance with another aspect of the teachings disclosed herein, which may be used alone or in combination with any other aspects, a method of treating the inner surface of a bore containing a shaft may include the steps of:

a) inserting a surface treating member into an annular gap formed between an outer surface of the shaft and an inner surface of a bore; and b) simultaneously pressing the surface treating member against the inner surface and moving the surface treating pad relative to the shaft and across the inner surface to treat the inner surface.

Step b) may be performed while maintaining a lateral gap between the surface treating member and the shaft.

Step b) may include at least one of rotating the surface treating member about the shaft and translating the surface treating pad axially along the shaft.

Step b) may include simultaneously rotating the surface treating member about the shaft and translating the surface treating pad along the shaft.

The method may include the step of positioning a body around the shaft and outside the bore so that the body can rotate relative to the shaft wherein the surface treating member is connected to the body and is movable with the body relative to the shaft.

The method may include driving the body using a driving apparatus that is mounted to the shaft.

The method may include a support member having a distal end that is axially spaced apart from the body and supports the surface treating member, wherein the distal end of the support member is insertable into the annular gap with the surface treating member.

In accordance with another aspect of the teachings disclosed herein, which may be used alone or in combination with any other aspects, an apparatus for cutting packing material disposed around a shaft extending through a bore may include a cutting tool having a body configured to movably receive the shaft and at least one cutting member connected to and movable with the body relative to the shaft. The at least one cutting member may be sized to be inserted within an annular gap formed between an outer surface of the shaft and an inner surface of the bore. A drive apparatus may be drivingly connected to the cutting tool to rotate the cutting tool about a tool axis relative to the shaft and to translate the cutting tool along the tool axis relative to the shaft to cause the at least one cutting member to translate axially into engagement with packing material within the annular gap while the cutting tool is rotating about the tool axis, thereby cutting the packing material while the packing material is contained within the annular gap.

The body may be configurable to laterally receive the shaft.

The body may include a collar having an aperture extending along a collar axis and sized to movably receive the shaft.

The collar may be configurable between a closed configuration, in which the aperture completely encircles the shaft, and an open position, in which the aperture is open to laterally receive the shaft.

The collar may include at least a first base portion and a second base portion that is detachably connected to the first base portion. Detaching the second base portion from the first base portion may open the aperture to laterally receive the shaft.

The drive apparatus may include a rotary drive apparatus to rotate the body about the tool axis.

The drive apparatus may include an axial drive to translate the cutting tool along the tool axis.

The axial drive and rotary drive may be operable simultaneously with each other.

The drive apparatus may include at least one mounting member to mount the drive apparatus to the shaft.

The at least one mounting member may be releasable, whereby the drive apparatus may be removably mountable to the shaft.

The at least one mounting member may include an openable clamp apparatus that is operable to laterally squeeze the shaft.

The axial drive may include a feed mechanism having a first gear and a second gear meshed to the first gear. The first and second gears may be configured to receive motive power from an external source and cause the cutting tool to translate along the tool axis.

The first gear may include a pinion and the second gear may include a linear gear that is axially movable relative to the shaft.

A hand crank may be engagable by a user and rotation of the hand crank may cause rotation of the first gear.

The axial drive may include a biasing member to urge the cutting tool away from the packing material.

The biasing member may be a recoil spring.

An indicator may be provided to provide an indication of an axial position of the cutting tool relative to the shaft.

In accordance with another aspect of the teachings disclosed herein, which may be used alone or in combination with any other aspects, an apparatus to service a valve having a valve stem and a stuffing box in situ, the apparatus may include a drive apparatus releasably mountable to the valve stem to support the apparatus and at least one of a cutting tool and a surface treating tool. The cutting tool may be connectable to the drive apparatus and may have a body configured to movably receive the valve stem and at least one cutting member connected to and movable with the body relative to the valve stem. The at least one cutting member may be sized to be inserted within an annular gap formed between an outer surface of the valve stem and an opposing inner surface of the stuffing box. When the cutting tool is connected to the drive apparatus, the drive apparatus may be operable to rotate the cutting tool about the valve stem and to translate the cutting tool along the valve stem to cause the at least one cutting member to translate axially into engagement with packing material disposed within the annular gap while the cutting tool is rotating about the tool axis, thereby cutting the packing material. The surface treating tool may be connectable to the drive apparatus and may have a body configured to movably receive the valve stem and at least one surface treating member connected to and movable with the body relative to the valve stem. The at least one surface treating may be member sized to be inserted within the annular gap. When the surface treating tool is connected to the drive apparatus and the packing material has been removed, the drive apparatus may be operable to translate the surface treating tool along the valve stem to cause the at least one surface treating member to translate axially into the annular gap and to bear against the inner surface of the stuffing box and to rotate the surface treating tool about the valve stem to move the surface treating member around the inner surface of the stuffing box to treat the inner surface of the stuffing box.

The cutting tool and the surface treating tool may be interchangeably connectable to the drive apparatus.

A suction apparatus may have a nozzle fluidly connected to a suction source. The nozzle may be positionable proximate the valve stem to extract from the stuffing box debris generated by use of at least one of the cutting tool and the surface treating tool while the at least one of the cutting tool and the surface treating tool is in use.

DRAWINGS

The drawings included herewith are for illustrating various examples of articles, methods, and apparatuses of the teaching of the present specification and are not intended to limit the scope of what is taught in any way.

DETAILED DESCRIPTION

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

Figure 1:
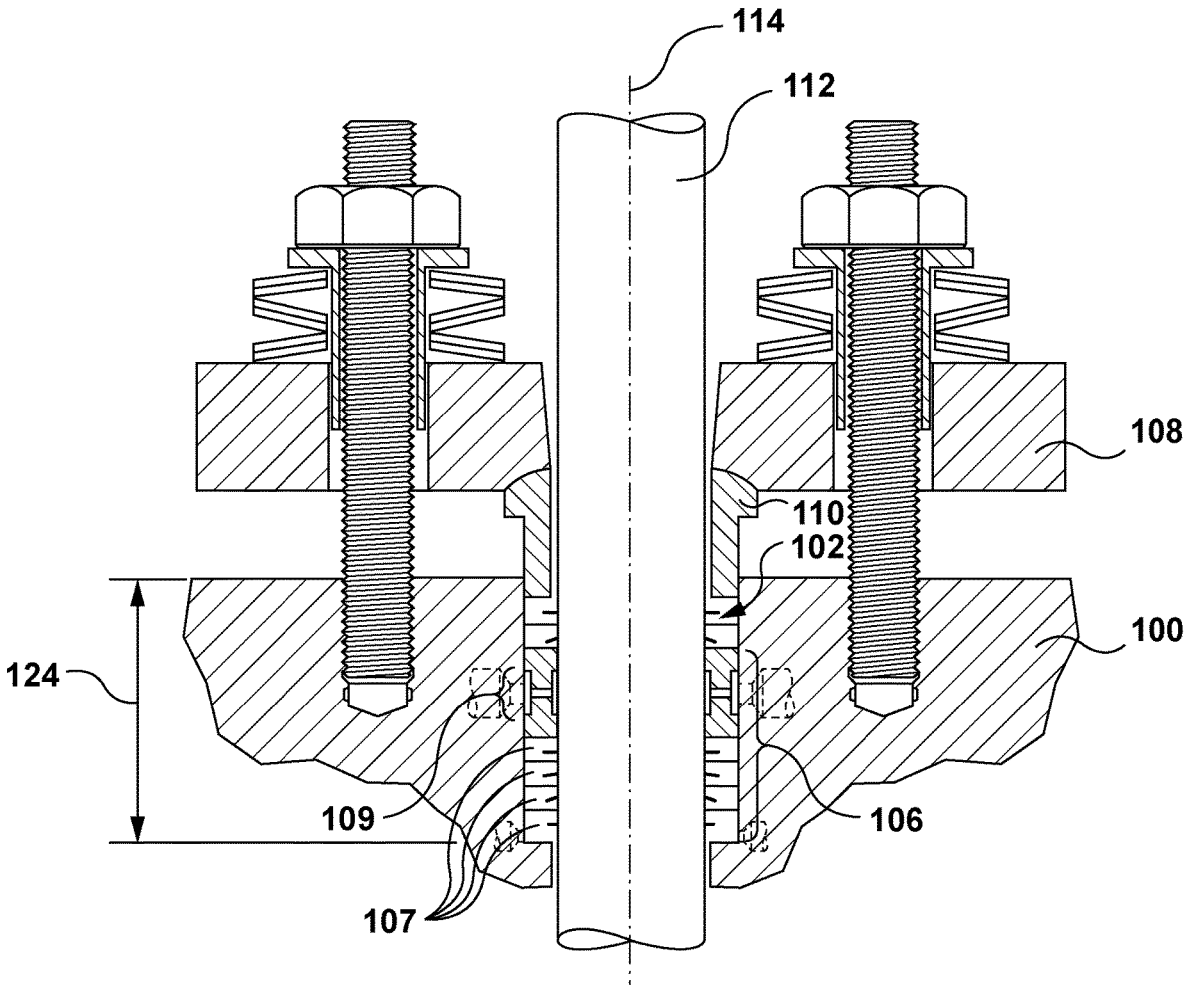
FIG. 1 is a cross-sectional view of a portion of a valve.

In valve packing systems, it may be desirable to keep the surfaces of the valve components clean and within specified surface roughness characteristics. These components are in contact with the valve packing rings that are used to provide valve sealing. The valve packing components typically in contact with packing materials are the valve stem and the inner walls of the packing stuffing box (bonnet bore). A typical valve packing configuration is shown in FIG. 1, and in FIG. 2 in which some elements have been removed for clarity. In the illustrated example, the valve includes a bonnet 100 with a cylindrical bore 102 that forms the stuffing box, having an inner surface 104. Packing material 106 is positioned within the stuffing box and secured in place by a combination of a gland plate 108 and gland follower 110.

The packing material 106 can include any suitable sealing and supporting members. In the illustrated schematic, the packing material 106 includes annular packing rings 107 and a lantern ring 109 that is disposed between some of the packing rings 107. Optionally, one or more packing rings 107 can be disposed above and/or below the lantern ring 109. The packing rings 107 may be formed from any suitable material, including, for example, packing materials such as graphite foil ribbon, graphite impregnated asbestos fiber, and wire reinforced packing rings. The lantern ring 109 may be formed from any suitable material, including, for example graphite and/or metallic materials, such as stainless steels such as Nitronic 60 ® (available from High Performance Alloys Inc. of Windfall, Ind.) and/or nickel-based allows such as Waukesha™ 88 (available from Waukesha Foundry Waukesha, Wis.).

The lantern ring 109 may have one or more radial conduits (not show) extending radially through the lantern ring 109. One or more of these conduits may be in fluid communication with ports 111 in the stuffing box 102. The ports 111 may be selectably sealed using any suitable member, including a threaded plug (not shown).

Figure 2:
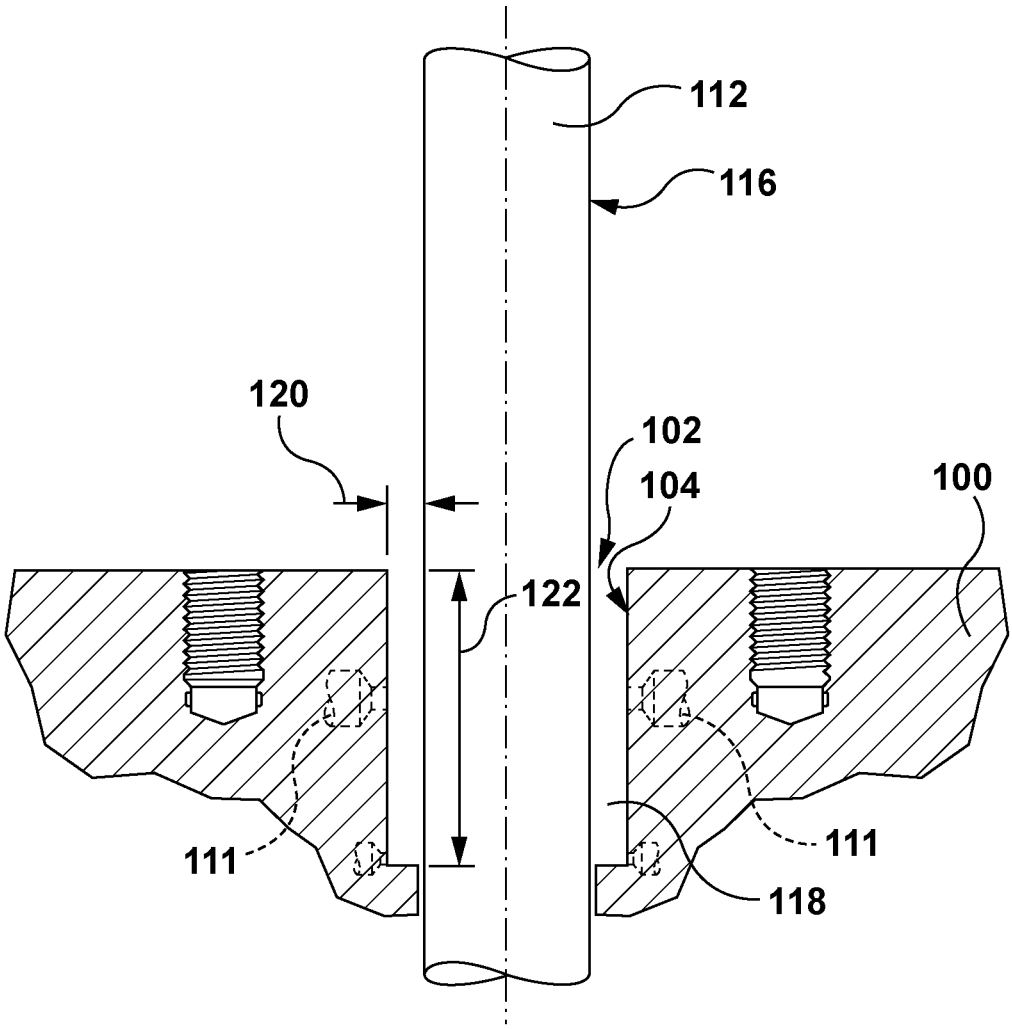
FIG. 2 is the cross-sectional view of FIG. 1 with some components removed.

A valve stem 112 extends along a stem axis 114 and through the stuffing box 102. The valve stem 112 has an outer surface 116 that engages the packing material 106 and can be connected to the valve gate (not shown) within the valve body and to a suitable valve actuator (such as a hand crank or motorized actuator). In most valves, the valve stem 112 is concentrically positioned within the stuffing box. In this arrangement, an annular volume 118 is defined between the inner surface 104 of the stuffing box 102 and the outer surface 116 of the valve stem 112. As shown in FIGS. 1 and 2, the radial distance 120 between the surfaces 104 and 116 defines the gap thickness, and the gap 118 has a length 122 in the axial direction that, in the illustrated example, is generally equal to the length 124 (FIG. 1) of the inner surface 104 (but need not be equal in all embodiments). In the illustrated configuration, the inner surface 104 of the packing stuffing box 102 is radially spaced apart from and surrounds the outer surface 116 of the valve stem 112.

When the valve 100 is in use, the surfaces on valve components may become soiled or damaged in ways that affect the surface finish of the inner surface 104 and the outer surface 116 of the valve stem 112. The surface finish may change over time due to, for example, corrosion.

From time to time, it may be desirable to remove the packing material 106 from the stuffing box 102. This may help facilitate inspection and maintenance of the stuffing box 102. In some situations, removing the packing material 106 can be challenging, for example, if the packing rings 107 and/or lantern ring 109 are stuck, seized, corroded or otherwise damaged or soiled.

During valve packing ring/lantern ring replacement there is the potential that a user may alter or damage the surface finish of the valve-packing components while manipulating and removing the packing material 106. Optionally a cutting tool may be used to help cut through the packing material 106. If the relevant surfaces (such as surfaces 104 and 116) are sufficiently scratched or sufficiently corroded that they no longer function properly and/or no longer have their specified surface roughness characteristics, then they may be refurbished using a suitable surface treating apparatus.

Examples of surface treating apparatuses can include grinding tools, honing tools, sanding tools, polishing tools and the like. While the term honing tool is used herein for convenience, it is understood that the teachings disclosed herein are not limited to "honing" operations, and instead may be utilized in any a variety of different embodiments of surface treating apparatuses to perform a variety of different surface treatment processes/techniques, including, for example, sanding, honing, grinding, and polishing. Similarly, while a valve packing stuffing box and valve stem are referred to herein for convenience, a similar relationship and similar annular volume may be provided on a variety of different apparatuses that include a shaft or other such member that extends through the interior of a surrounding bore, and the teachings disclosed herein need not be limited to treating surfaces of valves.

Surface treating tools are available on the market to treat and/or refurbish the inner surfaces of bores, such as a stuffing box on a valve apparatus. However, to use the honing products available on the market, the bore being treated must be generally empty and free from internal obstructions because the honing tool is inserted into the interior and occupies a large portion of the interior of the bore while in use. For example, to treat the inner surface of a valve packing stuffing box using conventional tools the valve stem is removed from the packing stuffing box to provide space within the interior of the packing stuffing box to position the honing tool. This can require disassembling significant portions of the valve, including the valve gate, yoke, actuator(s) and other surrounding structure. In some cases, it is desirable or required to disconnect and remove the entire valve from its associated piping network in order to perform the desired disassembly and honing operations in an off-site location, such as a machine shop.

In contrast to conventional surface treating tools, in accordance with the teachings disclosed herein, a surface treating apparatus, which in the illustrated embodiment is provided as a honing tool, is configured to enable portions of the honing tool to be inserted into the annular volume 118 defined between the valve stem 112 and the inner surface 104 of the stuffing box 102 and to treat the inner surface 104 of the stuffing box 102 without having to first remove the valve stem 112. Providing a honing tool that can fit within the radial thickness 120, and extend into the annular volume 118, may help facilitate treating the surface 104 of the stuffing box 102 (or optionally the surface 116 of the valve stem 112, or both) without removing the valve stem 112 from the stuffing box 102. This may help limit the amount of disassembly of the valve that is required in order to perform the honing operation, which may help reduce the cost and time required to treat the surface of the stuffing box. Providing a honing tool with this configuration may also help facilitate treating the surface of the stuffing box in situ, without requiring the valve to be removed from the piping assembly and sent off-site for treatment. For example, a honing tool can include a body and one or more surface treating members that are connected to and supported by the body. The body may be configured to be driven by a suitable drive source, and the surface treating members may be configured to fit within the annular volume 118. The surface treating members may be connected to the body in any suitable manner, and for example, may be either fixed or movably relative to the body. Optionally, the surface treating members can be coupled to the body using a suitable support member. Using a support member may help facilitate a desired spacing of the surface treating members relative the body. For example, if the body is too large to fit within the annular volume, a support member may be used to extend into the annular volume and support the surface treating member in a desired location. Optionally, the body may be configured to partially or completely surround the valve stem 112, or may be spaced from the valve stem in some embodiments.

Figure 3:
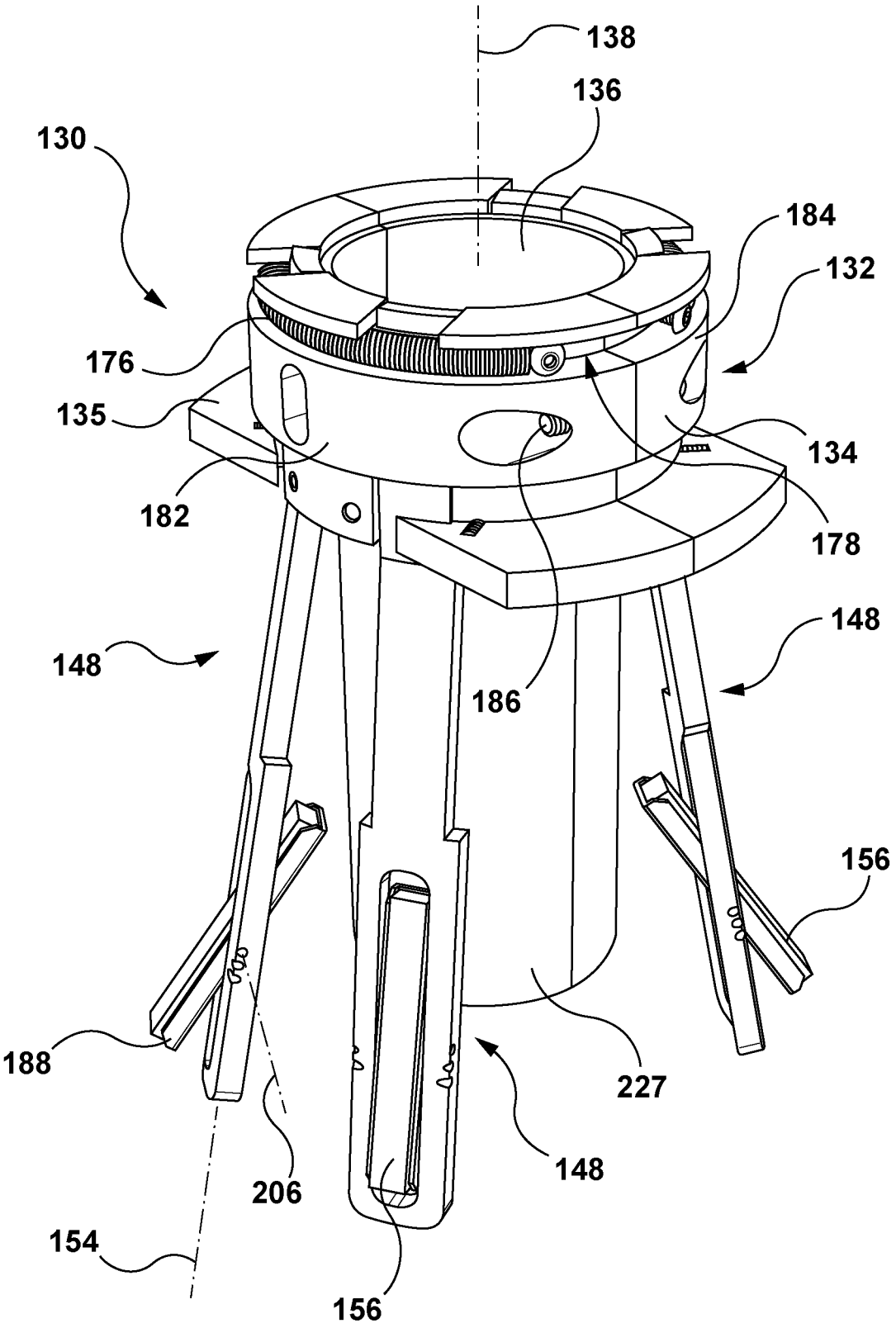
FIG. 3 is a perspective of a portion of a surface treating apparatus.

Referring to FIG. 3, one embodiment of a surface treating apparatus, in the form of a honing tool 130 is illustrated. The honing tool 130 is intended to be used to treat the inner surface 104 of a bore, i.e. a valve stuffing box 102, while a shaft, i.e. a valve stem 112, remains in positioned within the bore (i.e. isn't removed from within the bore of the stuffing box).

In the illustrated embodiment, the honing tool 130 includes a body in the form of a collar 132 and a plurality of surface treating members in the form of honing pads 156 that are connected to the collar 132. The collar 132 has a base portion 134 that surrounds a central aperture 136. The aperture 136 extends along a collar axis 138 and is sized to loosely fit around the columnar shaft portion of the valve stem 112 (FIG. 2). When the collar 132 is positioned around the valve stem 112, the valve stem 112 extends through the aperture 136 and the collar axis 138 is substantially coaxial with the collar axis 114 (FIG. 1). The collar 132 is configured so that it can move relative to the valve stem 112, and optionally can be configured to rotate relative to the valve stem (about the collar axis 138), translate axially relative to the valve stem, or both. Optionally, the collar 132 may be simultaneously rotated and translated relative to the valve stem 112.

Figure 4:
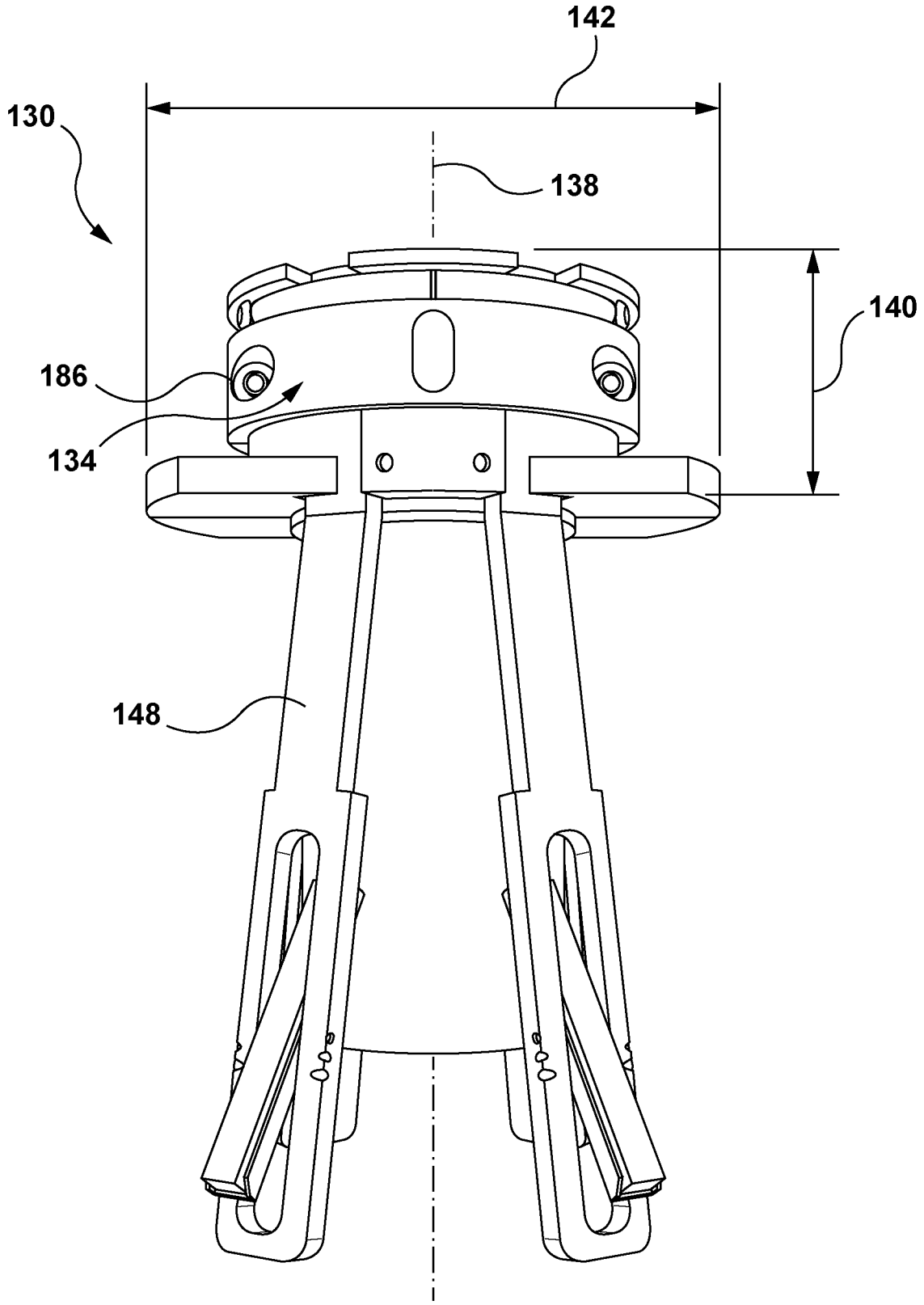
FIG. 4 is a side view of the portion of the surface treating apparatus of FIG. 3.

Referring to FIG. 4, the body 134 has a height 140 in the axial direction and an outer diameter 142 in a lateral direction that is generally orthogonal to the axial direction (e.g. the radial direction in the embodiment illustrated). The height 140 and outer diameter 142 may be selected based on the intended use of the honing device 130. For example, the height 140 may be any suitable height, and may be, for example, between about 5 mm and about 300 mm or more, and optionally may be between about 10 mm and about 100 mm, and may be between about 15 mm and about 60 mm. The outer diameter 142 may be selected so that the collar can be positioned around the valve stem without interfering with the yoke, actuator or other valve components. The outer diameter 142 of a given collar may selected based on its intended application, and may be between about 10 mm and about 300 mm or more, and may be between about 50 mm and about 200 mm.

Figure 5:
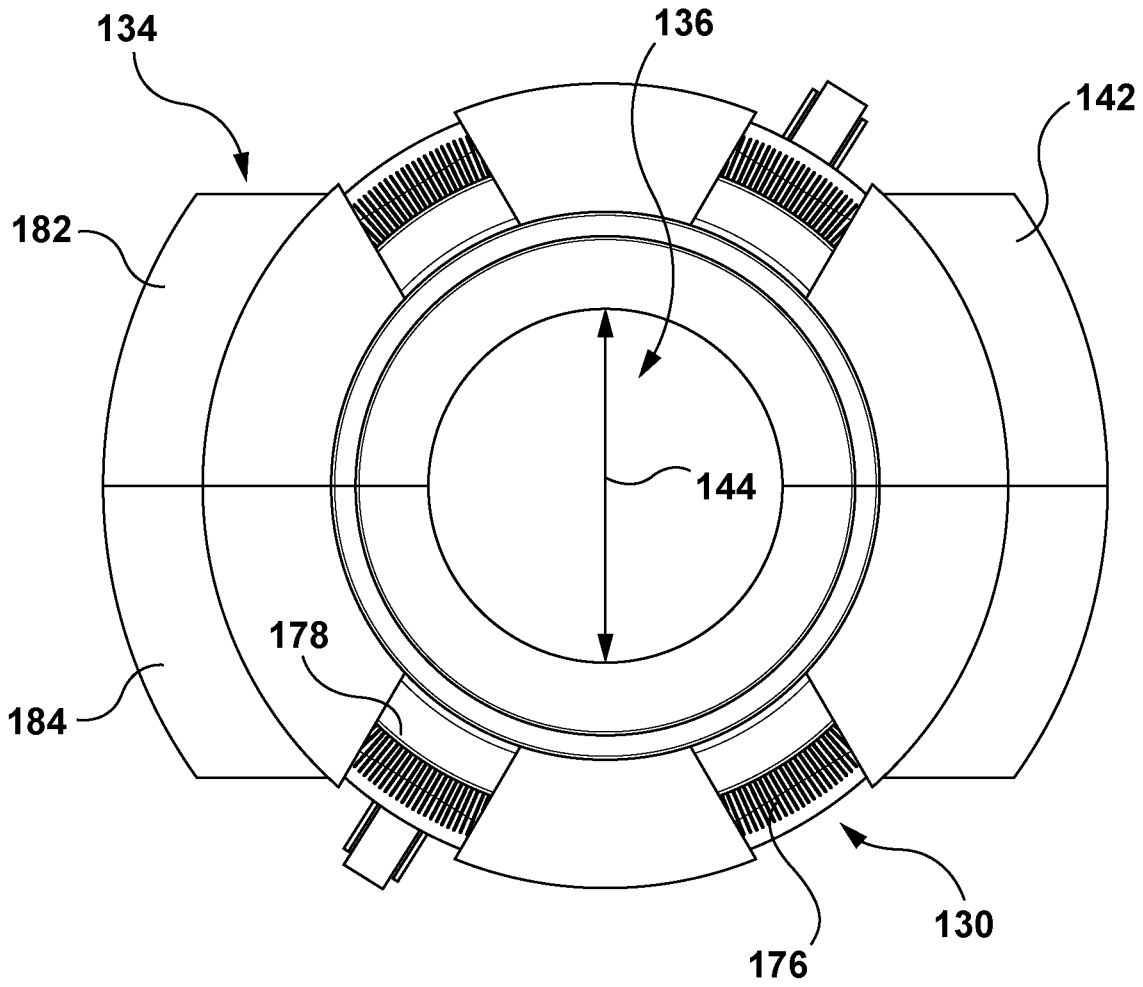
FIG. 5 is a top view of the portion of the surface treating apparatus of FIG. 3.

Referring also to FIG. 5, the aperture 136 also defines an aperture diameter 144 that is less than the outer diameter 142. The aperture diameter 144 may be sized to loosely receive a given valve stem 112 so that the collar 132 can be rotated about the collar axis 114 relative to the valve stem 112 when the honing tool 130 is in use. The aperture diameter 144 may be any suitable size, and may be, for example, between about 5 mm and about 200 mm or more, and may be between about 10 mm and about 40 mm.

Preferably, at least one supporting member extends generally axially from the collar 132 and is configured to at least partially fit within the annular volume 118 between the valve stem 112 and the inner surface 104. The supporting member can be used to support and position a suitable surface treating member within the annular volume 118 (such as a honing pad, sanding pad, grinding pad, etc.) and to press the surface treating pad against the surface to be treated (i.e. the inner surface 104). Optionally, the surface treating pad can be attached to one end of the supporting member and the other end of the support member can be connected to the collar 132, so that the support member (and surface treating pad mounted thereon) can rotate with the collar about the collar axis 138. Optionally, the supporting member and surface treating pad may move in unison with collar 132.

Referring to FIG. 3, in the illustrated embodiment the honing tool 130 includes four support members in the form of elongate support arms 148. Each support arm 148 in the illustrated example is identical. Alternatively, in other embodiments the supporting members on the honing tool need not be identical to each other.

Figure 6:
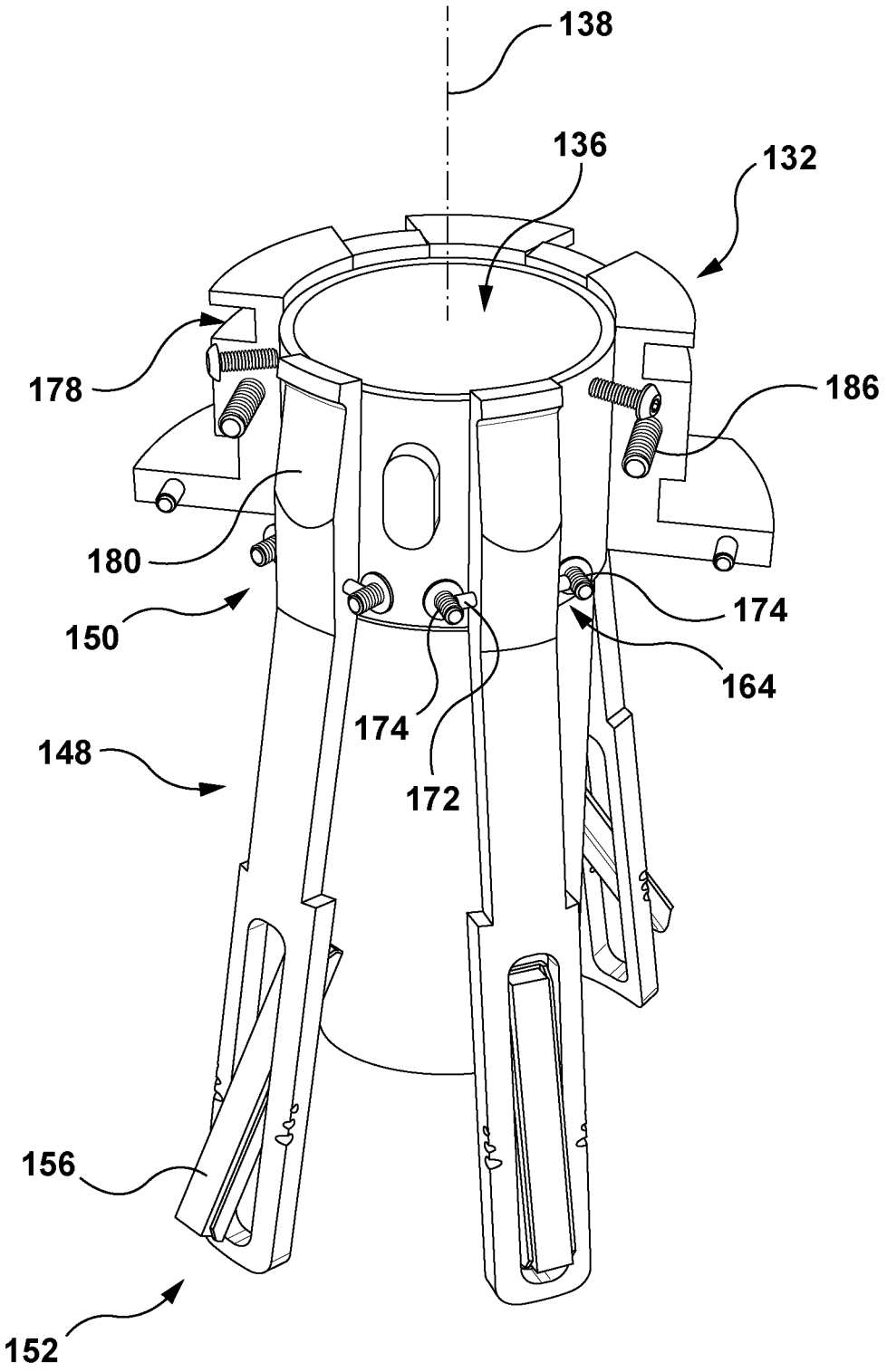
FIG. 6 is a perspective of the portion of a surface treating apparatus of FIG. 3 with a portion of the collar removed.
Figure 7:
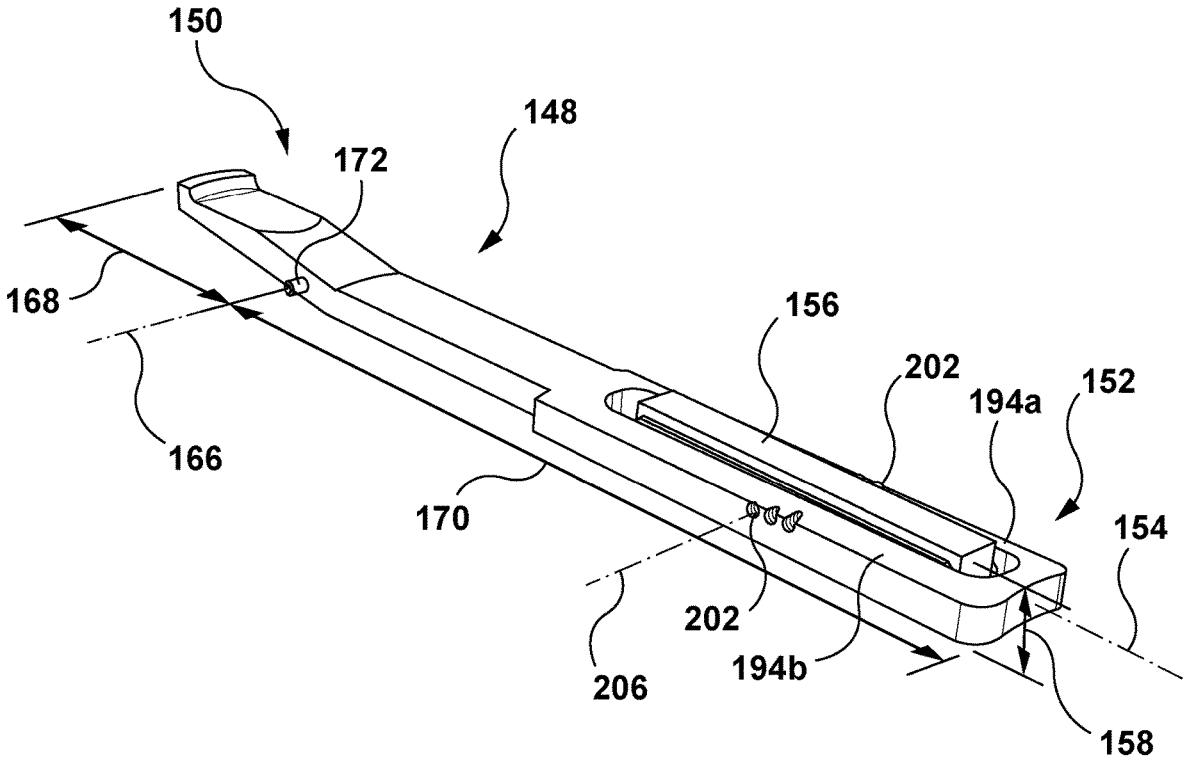
FIG. 7 is a perspective view of a portion of the surface treating apparatus of FIG. 3.
Figure 8:
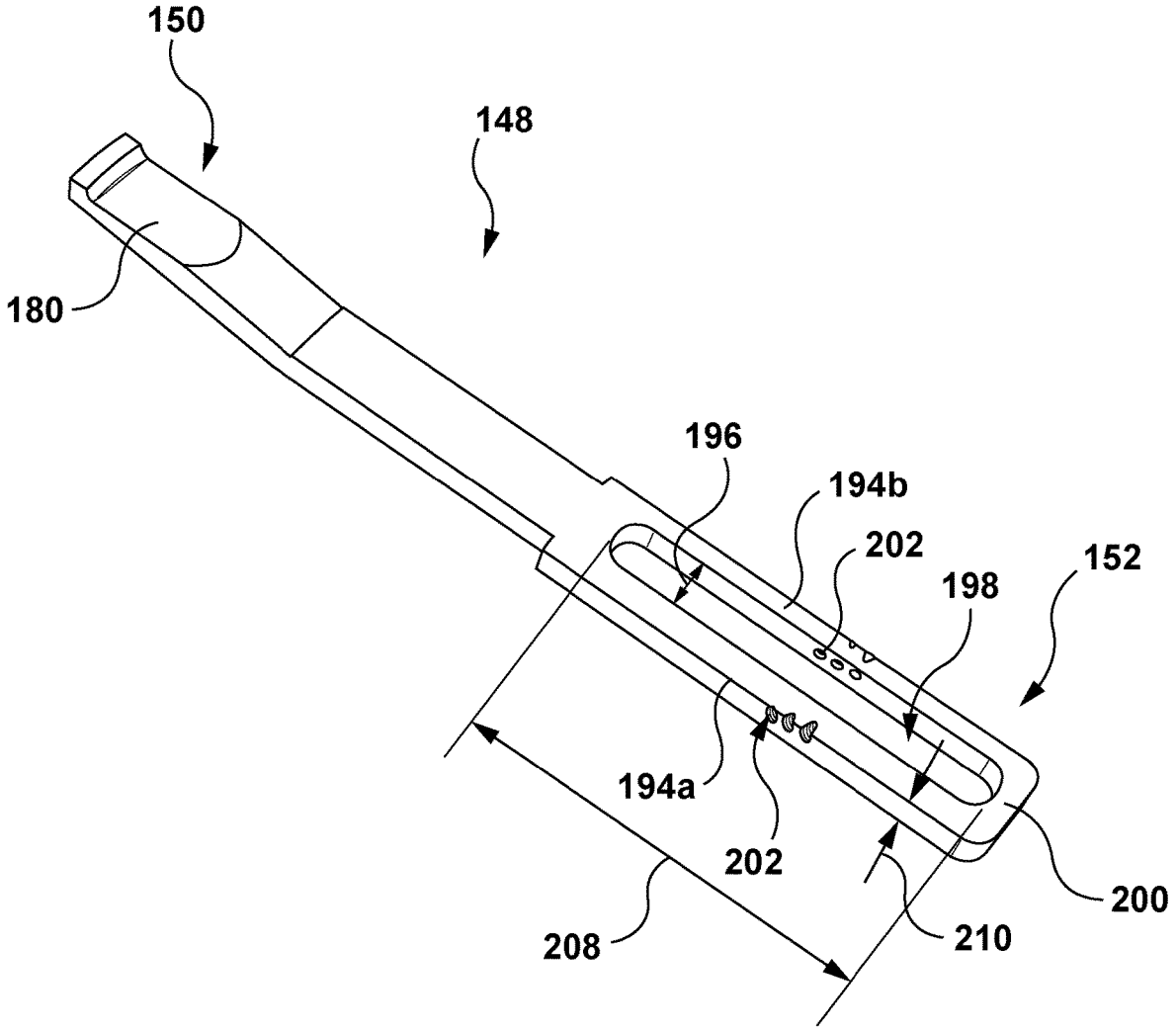
FIG. 8 is a perspective view of the portion of the surface treating apparatus of FIG. 7 with the surface treating pad removed.

Referring also to FIG. 6, in which a portion of the collar 132 has been removed to reveal the arms 148, and FIGS. 7 and 8, the support arm 148 has a proximal end 150 that is connected to the body 134 and a distal end 152 that is axially spaced apart from the body 134 and the proximal end 150 along an arm axis 154. In this example, the distal end 152 is sized to be inserted into the annular volume 118 formed between the valve stem 112 and the inner surface 104.

Figure 9:
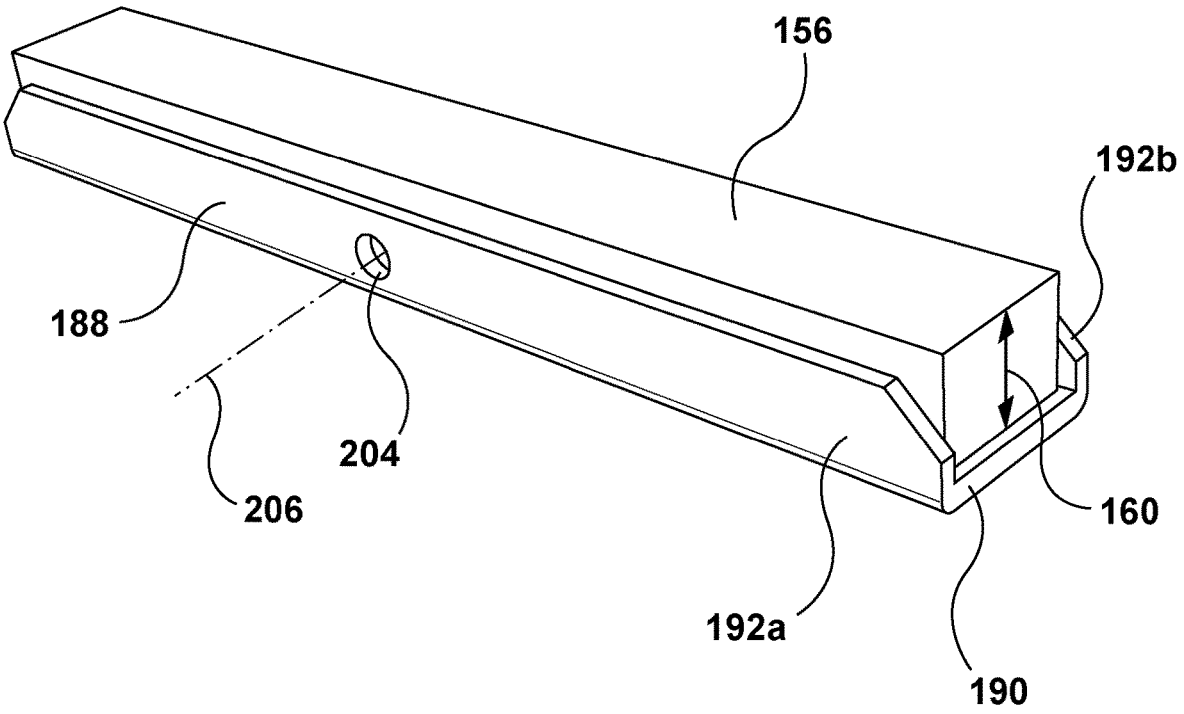
FIG. 9 is a perspective view of a surface treating pad on a pad support that is usable in combination with the portion of the surface treating apparatus of FIG. 8.

Referring also to FIG. 9, a surface treating member in the form of a honing pad 156 is mounted to the distal end 152 of the support arm and is also sized to be inserted within an annular volume 118.

Referring to FIG. 7, in the illustrated example, the distal end 152 of the support arm 148 has an overall thickness 158, which when the honing tool 130 is in use is generally in the radial direction. The thickness 158 is selected in the current example so that it is less than the radial thickness 120 of the annular volume 118. Referring also to FIG. 9, in the illustrated example, the honing pad 156 has a thickness 160 that is less than the radial thickness 120. The honing pad thickness 160 may be selected so that it is at least 50% of the radial thickness 120, and optionally so that it is between about 60% and about 98% of the radial thickness 120 when mounted on the base plate 190. This may help facilitate the use of honing pads 156 that are relatively thick, as compared to the radial thickness 120, which may help extend the useful life of the honing pad and/or may help increase the strength of the honing pads (as compared to a thinner honing pad).

Optionally, the honing tool 130 may be configured such that the thickness 160 of the honing pad 156 is greater than the thickness 158 of the distal end 152 of the support arm 148. Optionally, the honing pad thickness 160 may be between about 2 mm and about 100 mm or more, and may be between about 4 mm and about 10 mm.

Optionally, to help press the honing pad 152 against the surface 104 to be treated, the distal end 152 of the support arm 148 can be biased radially outwardly, away from the collar axis 138. The support arm 148 may be biased using any suitable mechanism, including, for example, springs, elastics and other biasing elements and/or or may be resiliently flexible to urge the honing pads 156 towards, and against, the inner surface 104. The amount of biasing force exerted on the support arm 148 may be selected based on a variety of factors, including, for example, the size of the honing pad 156, the coarseness or grit of the honing pad 156, the surface condition of the inner surface 104 of the stuffing box 102 and the like.

Referring to FIG. 6, in the illustrated embodiment each support arm 148 is pivotally connected to the collar 132, such that the distal end 152 of the arm can be moved, in a generally radial direction, away from and toward the collar axis 138 to engage and disengage the inner surface 104 of the stuffing box 102, respectively.

In the illustrated embodiment, the support arm 148 is pivotally connected to the collar 132 by a pivot joint 164 defining a pivot axis 166 that is located between, and is spaced apart from both the proximal and distal ends 150, 152 of the arm 154 by respective pivot offset lengths 168 and 170 (FIG. 7), respectively. In the illustrated embodiment, the pivot joint includes a pin 172 that passes through the support arm 148 and engages corresponding supports, in the form of stop screws 174 on the collar 132.

In this arrangement, the pivot joint 164 may act as a fulcrum for the support arm 148 such that the distal end 152 and proximal end 150 move in opposite directions when the support arm 148 is pivoted about the pivot axis 166. For example, urging the proximal end 150 inwardly toward the collar axis 138 will cause the distal end 152 to move outwardly away from the collar axis 138, and vice versa. In this configuration, the distal end 152 of the support arm 148 can be biased outwardly by biasing the proximal end 150 of the support arm 148 inwardly. This may help facilitate positioning the biasing member toward the proximal end 150, instead of toward the distal end 152, which may help reduce the size of the distal end 152. This may also help configure the honing tool 130 such that the portion of the support arm 148 that is outboard of the pivot joint 164 (i.e. between the pivot joint 164 and the distal end 152) can be entirely supported by the collar 132 and need not have any contact with the valve stem 112 (i.e. there is no need to have a biasing member acting between the valve stem 112 and the support arm 148). This may help facilitate movement of the support arm 148 relative to the valve stem 112 in both the circumferential and axial directions without contacting or damaging the surface 116 of the valve stem 112.

Alternatively, in other embodiments the pivot joint may be provided at the proximal end of the arm or at any other suitable location along the length of the arm.

Referring also to FIG. 5, in the illustrated embodiment, the honing tool 130 has a biasing member in the form two garter springs 176 that extend circumferentially around the periphery of the body 134, and are nested within corresponding spring grooves 178 provided on the outer surface of the body 134. Optionally, the springs 176 may be removably seated within the spring grooves 178. This may help facilitate installation of the springs 176 and removal of the springs 176 for servicing or repair. It may also help facilitate the use of multiple, different springs with the same honing tool, for example, to vary the biasing forces for different applications. Alternatively, instead of a spring, the biasing member may be provided as a resilient band, an elastic member or the like.

The springs 176 may engage some or all of the support arms 148 in any suitable manner that achieves the desired biasing and movement of the support arms 148. In the illustrated embodiment, each support arm 148 is provided with a bearing surface 180 (FIGS. 6 and 8) toward its proximal end 150 that is configured to receive and be engaged by the spring.

Optionally, a common biasing member may be used to engage at least two of the arms, and optionally all of the arms on the honing tool. Using a common biasing member to engage the two or more support arms 148 may help facilitate applying a generally equal biasing force to those support arms 148. This may help ensure that the honing pads 156 on those support arms 148 are pressed against the stuffing box surface 104 with generally equal force, which may help provide a desired honing treatment. Alternatively, different biasing members may be used for each arm, and may optionally be arranged to provide generally equal, or different biasing forces on each arm.

In the illustrated embodiment, each spring 176 simultaneously contacts the bearing surfaces 180 of each of the two support arms 148, which may help balance the biasing forces applied to those support arms 148. Alternatively, a single spring may extend around the entire perimeter of the collar 132 and may engage all of the support arms 148, or more than two springs may be used.

The collar 132 may be mounted around the valve stem in any suitable manner. For example, the collar 132 may be slid axially over a free end of the valve stem 112, and then translated along the length of the valve stem 112 to a desired operating location. This may be suitable when an upper end of the valve stem 112 is exposed and there are no barriers between the end of the valve stem and the desired operating location.

Figure 10:
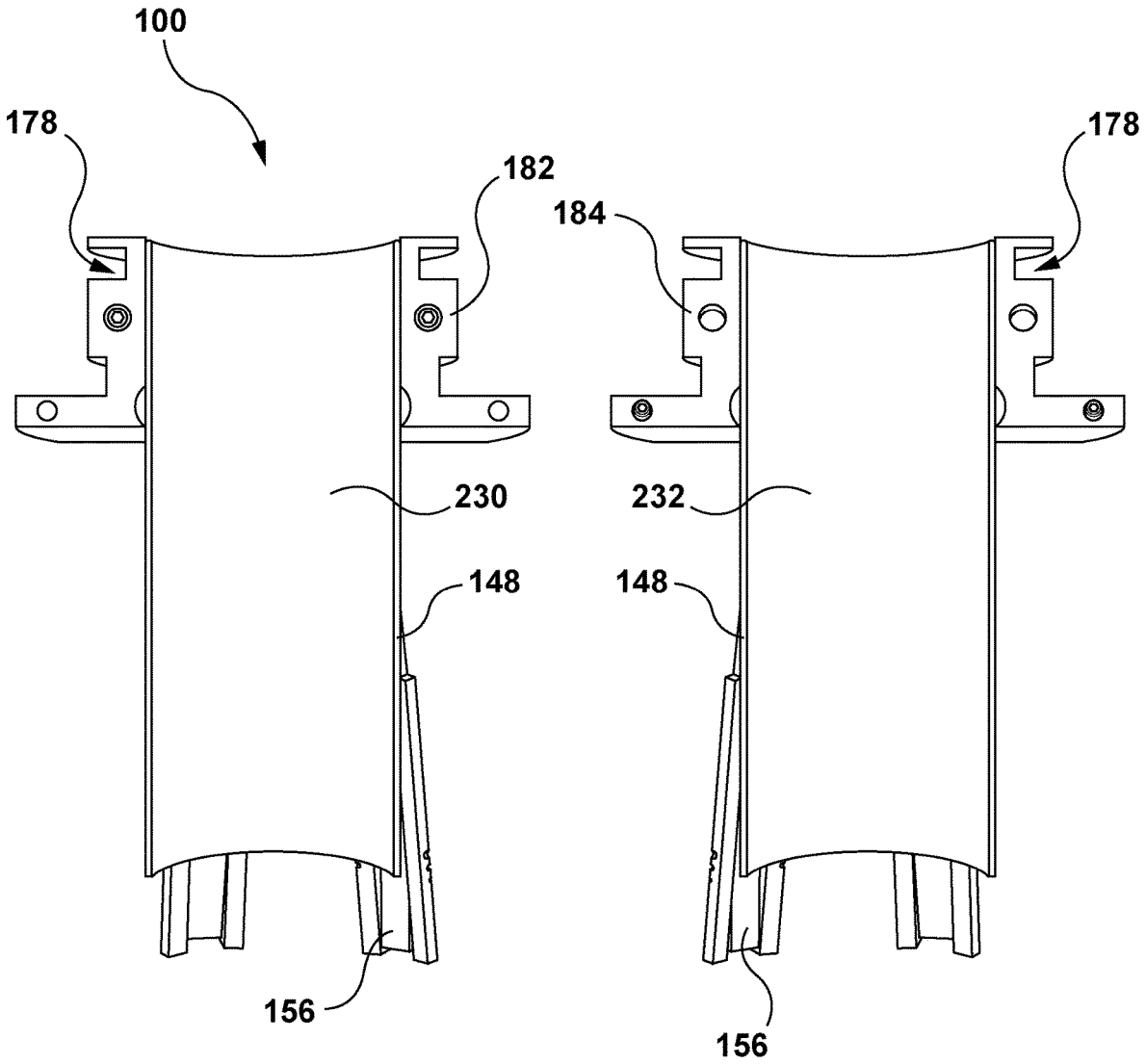
FIG. 10 is a perspective view of the portion of the surface treating apparatus of FIG. 3 in an open configuration.

Alternatively, the collar 132 may be configured so that the aperture 136 can be opened to laterally receive the valve stem 112, and then closed around the valve stem 112 (see FIG. 10). Providing an openable aperture 136 may help facilitate mounting the collar 132 to valve stems 112 in which the ends of the valve stem 112 are blocked and/or where barriers, such as yoke, actuators, instrumentation, etc. make axially sliding the collar 132 along the valve stem 112 less desirable. Providing a laterally mountable collar 132 may also help reduce the amount of valve disassembly required in order to utilize the honing tool 130. The collar 132 may have any suitable configuration that allows the aperture to be opened, including for example including two or more base portions that are movably connected to each other. The base portions may be pivotally or hingedly connected to each other so that the collar can remain substantially in one piece while the aperture is opened. Alternatively, the base portions may be detachable from each other so that the collar is separated into at least two, unattached portions when the aperture is opened and the portions are then re-attached to each other the close the aperture around the valve stem.

Referring to FIG. 10, in the illustrated embodiment the body 134 includes a first base portion 182 and a second base portion 184 that is detachably connected to the first base portion 182 using threaded fasteners 186 (FIGS. 3 and 4). This may allow the collar 132 to be configurable in an open configuration (FIG. 10) and a closed configuration (FIG. 3). In this example, detaching the second base portion 184 from the first base portion 182 opens the aperture 136 to laterally receive the valve stem 112 (FIG. 10), and re-attaching the second base portion 184 to the first base portion 182 closes the aperture 136 (FIG. 3). In this configuration, when the base portions 182 and 184 are attached the collar 132 fully encircles the valve stem 118. Alternatively, the body of the honing tool may be configured so that when it is in position for use it does not completely encircle the valve stem 118. For example, the body could be generally C-shaped such that it can be radially/laterally positioned around the valve stem 118 but maintains an open region or a circumferential gap, such that the body does not completely enclose the valve stem. This may help facilitate positioning the body around the valve stem without having to reconfigure the body.

Stone Holder and Pivoting

For a given honing tool, the honing pads may be connected to the distal ends of the arms using any suitable mechanism, including, for example, mechanical fasteners, adhesives, friction fit or other physical engagement, magnets and the like. Optionally, the honing pads may be directly connect to its respective arm (or an integrally formed pad support portion), or alternatively a separate pad support may be provided such that the honing pad is mounted to the pad support, and the pad support is connected to the arm. The honing pad may be movable relative its supporting arm, which may help facilitate aligning the honing pad with the surface to be treated.

Referring to FIG. 9, in the illustrated embodiment the honing tool includes pad supports 188 pivotally coupled to the distal end 152 of each support arm 148 and the honing pads 156 are mounted to the pad supports 188, and thereby indirectly connected to the support arms 148 (see also FIG. 3).

In the illustrated example the pad support 188 is a generally U-shaped member having a base portion 190 configured to receive the honing pad 156, and first and second upstanding flanges 192*a* and 192*b* that are spaced apart from each other and are provided at opposing edges of the base portion 190.

The arms and pad supports may be of any suitable, compatible design so as to facilitate the desired mounting arrangement. Referring to FIG. 8, in the illustrated example, the distal end 152 of the support arm 148 is configured to include a pair of spaced apart fingers 194*a* and 194*b*. In the illustrated example, the fingers 194*a* and 194*b* are generally parallel to each other and extend axially from a central portion of the arm 148. The fingers 194*a* and 194*b* are spaced apart from each other in a circumferential direction (i.e. around the perimeter of the body and shaft 112) by a finger distance 196 that is selected to allow the pad support 188 and honing pad 156 to be positioned in a cavity 198 defined between the fingers 194*a* and 194*b*. In the illustrated example, the ends of the fingers 194*a* and 194*b* are joined together by an endwall 200 such that the cavity 198 is bounded on four sides. Alternatively, an endwall need not be provided and the distal ends of the fingers 194*a* and 194*b* may be free and unattached. In such a configuration, the cavity 198 may only be bounded on three sides. In the illustrated example, both of the radially inner and outer faces of the cavity 198 are open. This may help facilitate installation of the honing pads 156 and may help facilitate movement of the pads 156 relative to the support arm 148. Alternatively, the radially inner face of the cavity 198 may be partially or completely enclosed.

Referring to FIGS. 7-9, in the illustrated example, the fingers 194*a* and 194*b* and flanges 192*a* and 192*b* are provided with complimentary pairs of bores 202 and 204 that can be aligned when the pad holder 188 is positioned within the cavity 198. Optionally, as illustrated, the fingers 194*a* and 194*b* may include multiple pairs of bores that are provided at different locations. This may help accommodate honing pads 156 of different sizes and/or configurations.

A pin, or pins, may be inserted into the bores 202 and 204 to pivotally connect the pad support 188 to the support arm 148. That is, the first flange 192*a* may be configured to connect to the first finger 194*a* and the second flange 192*b* may be configured to connect to the second finger 194*b*, thereby connecting the pad support 188 to the support arm 148. In this arrangement, the pad support 188 is movably connected to the support arm 148 and can pivot, relative to the arm, about a pad pivot axis 206. In the illustrated configuration, the pivot axis 206 is generally orthogonal to the collar axis 138 and is positioned such that the axis 206 intersects the first and second fingers 194*a* and 194*b* and passes through the honing pad 156. This configuration may help facilitate nesting the pad support 188 and honing pad 156 between the fingers 194*a* and 194*b*, which may help reduce the overall size and radial thickness of the arm 148. Reducing the overall size may help facilitate the use of the honing tool in relatively small gaps 118.

Optionally, the honing pad 156 may also include a bore such that a single pin can extend through the honing pad 156, from the first finger 194*a* to the second finger 194*b*. Alternatively, two pins can be used so that while the axis 206 intersects the honing pad 156, a solid pin does not actually pass through the pad 156.

Referring to FIG. 8, the fingers have a length 208 that is selected so that the fingers can accommodate a desired pad support 188 and honing pad 156. The length 208 can be between about 10 mm and about 250 mm or more, and may be between about 20 mm and about 100 mm. The fingers also have a thickness 210 in the radial direction that is selected so that the fingers 194*a* and 194*b* can be inserted into the gap 118 (FIG. 2). Optionally, the thickness 210 may be between about 2 mm and about 50 mm, and may be between about 4 mm and about 10 mm, and may be about 5 mm or less. Optionally, the thickness 160 of the honing pad 156 may be less than the thickness 210 of the fingers 194*a* and 194*b*, or alternatively, as illustrated, may be greater than the thickness 210.

In the illustrated example, the honing pad 156 is at least partially nested between the fingers 194*a* and 194*b* (i.e. at least partially overlaps with the arm 148 in the thickness/radial direction), such that the overall thickness 158 of the distal end 152 of the arm 148 is less than the sum of the finger thickness 210, the pad thickness 160 and the thickness of the pad support 188 (if included in a given embodiment). Optionally, the honing pad 156 can be configured so that the thickness 160 of the honing pad 156 is between about 5% and 30% of the diameter of the collar aperture.

Figure 11:
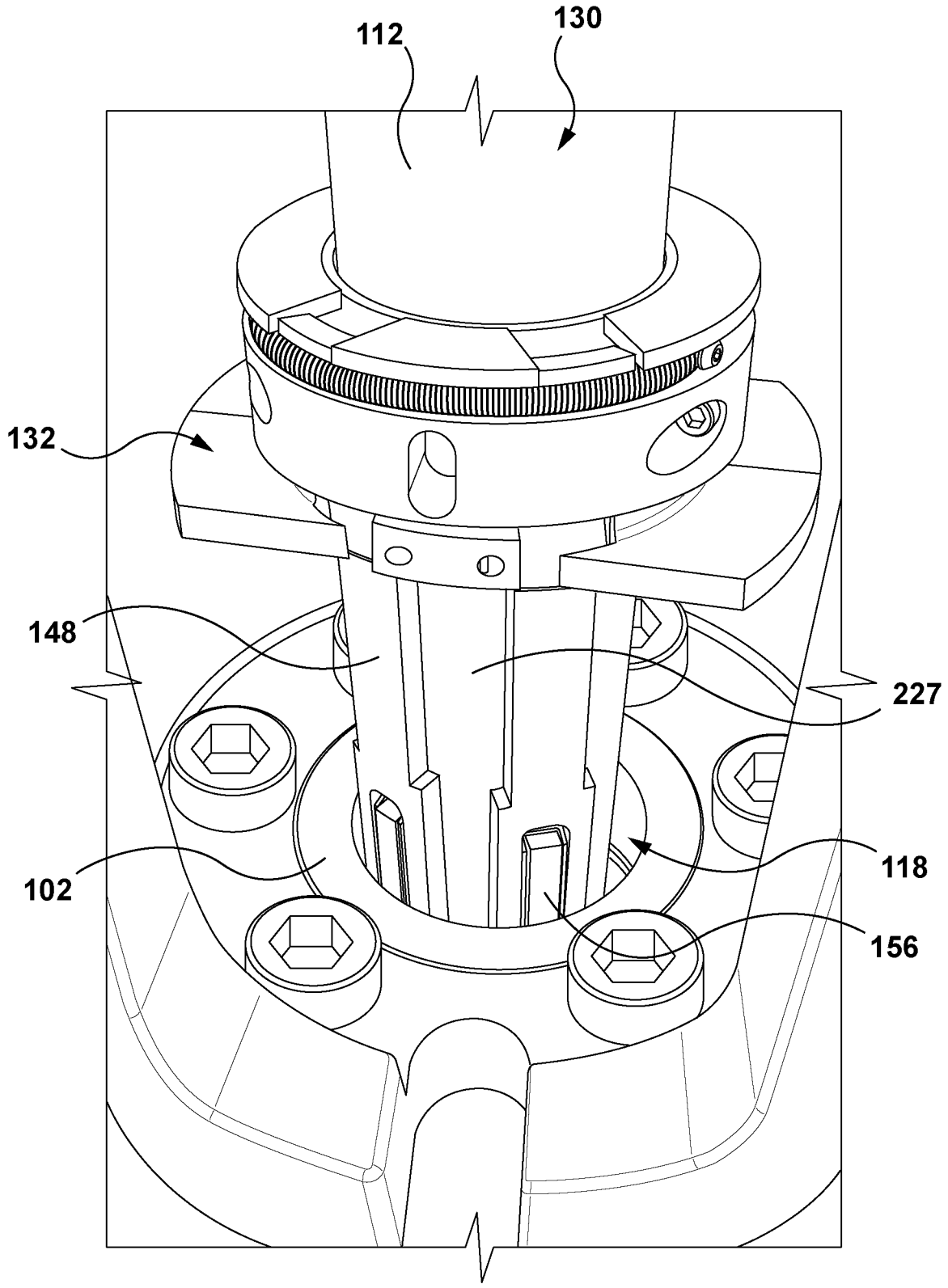
FIG. 11 is a perspective view of the portion of the surface treating apparatus of FIG. 3 engaged with an inner surface of a valve stuffing box.
Figure 12:
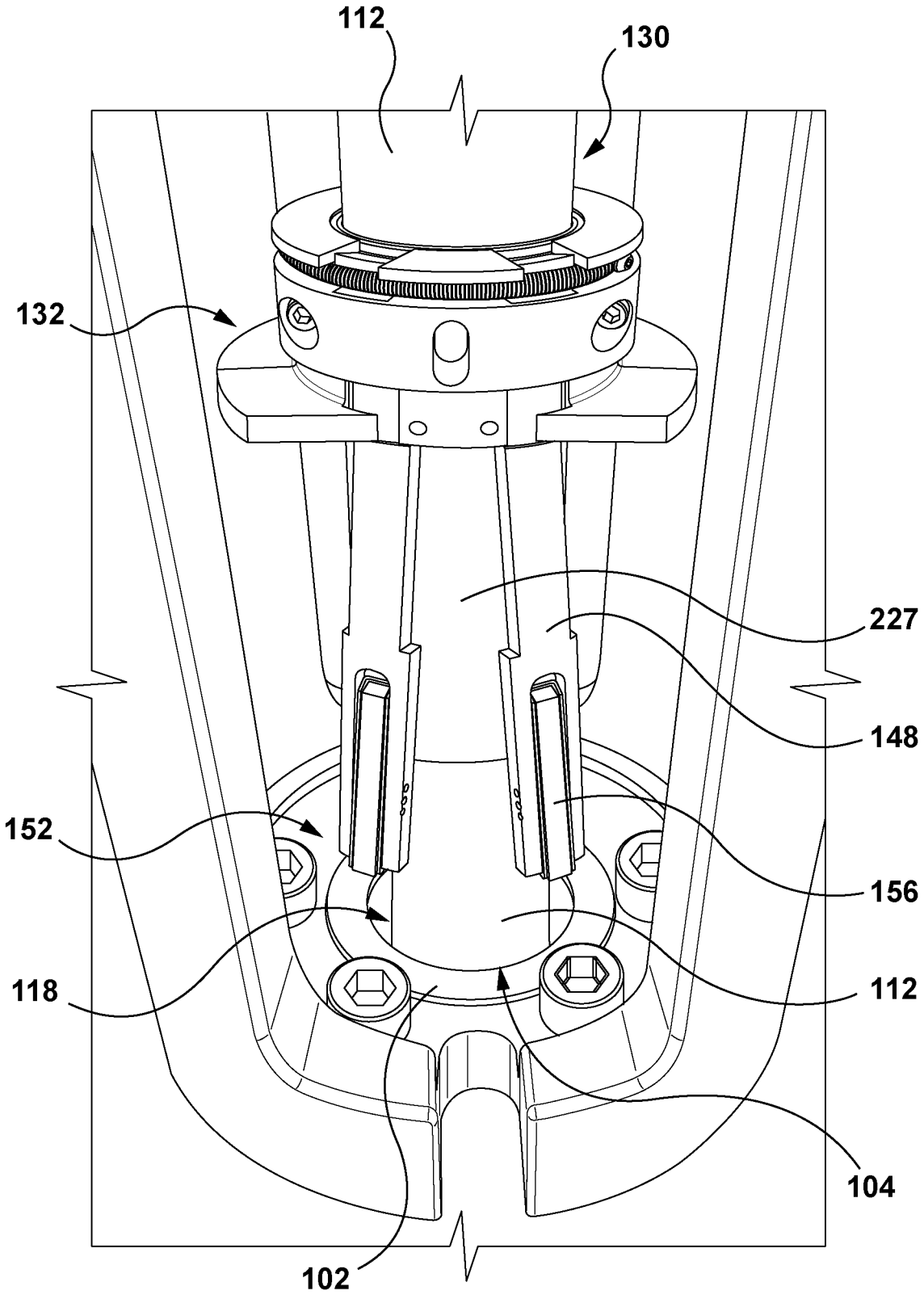
FIG. 12 is the perspective view of FIG. 11 with the surface treating tool disengaged from the inner surface of a valve stuffing box.

Referring to FIG. 12, the honing tool 130 is shown positioned around a valve stem 112, with the arms 148 outside the annular gap 118 and biased outwardly. Referring to FIG. 11, the honing tool 130 is shown with the distal ends 152 of the support arms 148 partially inserted within the gap 118, such that the honing pads 156 are in contact with the inner surface 104. To transition from the configuration of FIG. 12 to the configuration of FIG. 11, the support arms 148 can be pivoted (either manually or otherwise) into a generally axial position and the tool 130 can then be translated downwardly.

Drive Apparatus

When the honing tool 130 is in use, the collar 132 may be supported and driven by any suitable drive apparatus. Preferably, the drive apparatus includes a rotary drive component to rotate the collar 132 about the collar axis 138, whereby the surface honing pad 156 can be moved across the inner surface 104 (i.e. around its circumference). Optionally, the drive apparatus may also include an axial drive to translate the collar 132, the at least one support arm 148, and the honing pad 156 mounted thereto, axially along the collar axis 138.

Optionally, the axial drive and rotary drive are operable simultaneously with each other so that the honing pad 156 can be moved simultaneous across the surface 104 in two directions simultaneously.

Either of the drive portions can include a drive source, such as an electric motor, engine, hand crank, manual handle or the like, and can be provided with any suitable transmission mechanism, such as gears, belts, pulleys and the like to transmit power from the drive source to the collar. Optionally, a common drive source may be used for both the rotary and axial drive sources.

Optionally, the drive apparatus may be mounted to the valve stem using any suitable mounting apparatus. For example, the drive apparatus may include a mounting member that is operable to engage the valve stem to secure the drive apparatus to the valve stem, and optionally to support the entire weight of the drive apparatus and any tools connected thereto. This may reduce the need for external mounting equipment. This may also help reduce the overall size of the honing tool, and/or may help facilitate a desired alignment between the collar axis and the valve stem axis. Preferably, when the honing tool 130 is in use, the collar axis 138 is coaxial with the valve stem axis 114. Alternatively, the drive apparatus may be mounted to any other suitable portion of the valve (or other object that is being treated) or may be provided with a separate supporting stand that can hold the honing tool in position without directly contacting the valve stem or valve body.

Figure 13:
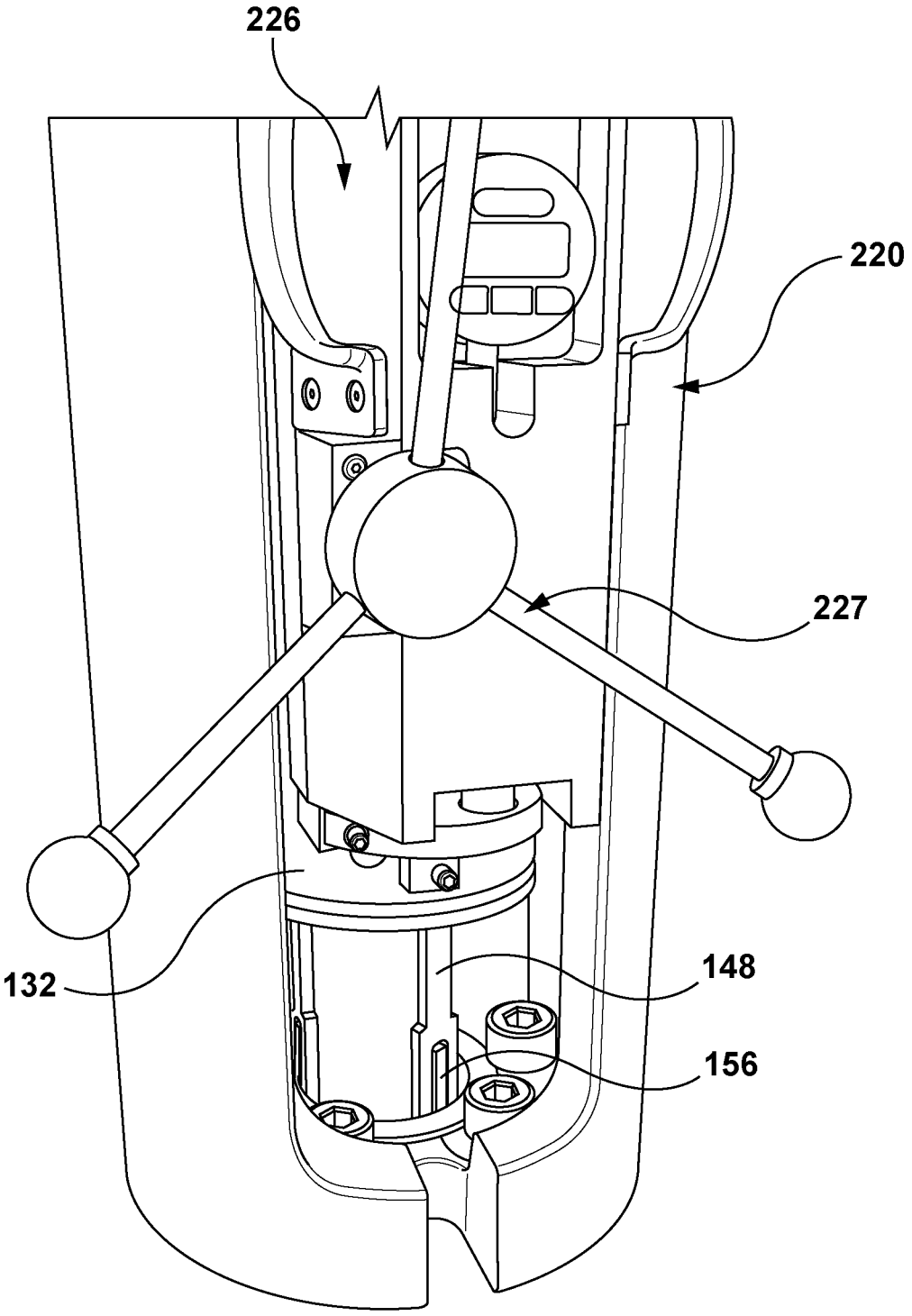
FIG. 13 is a perspective view of the surface treating tool mounted on a portion of a valve.
Figure 14:
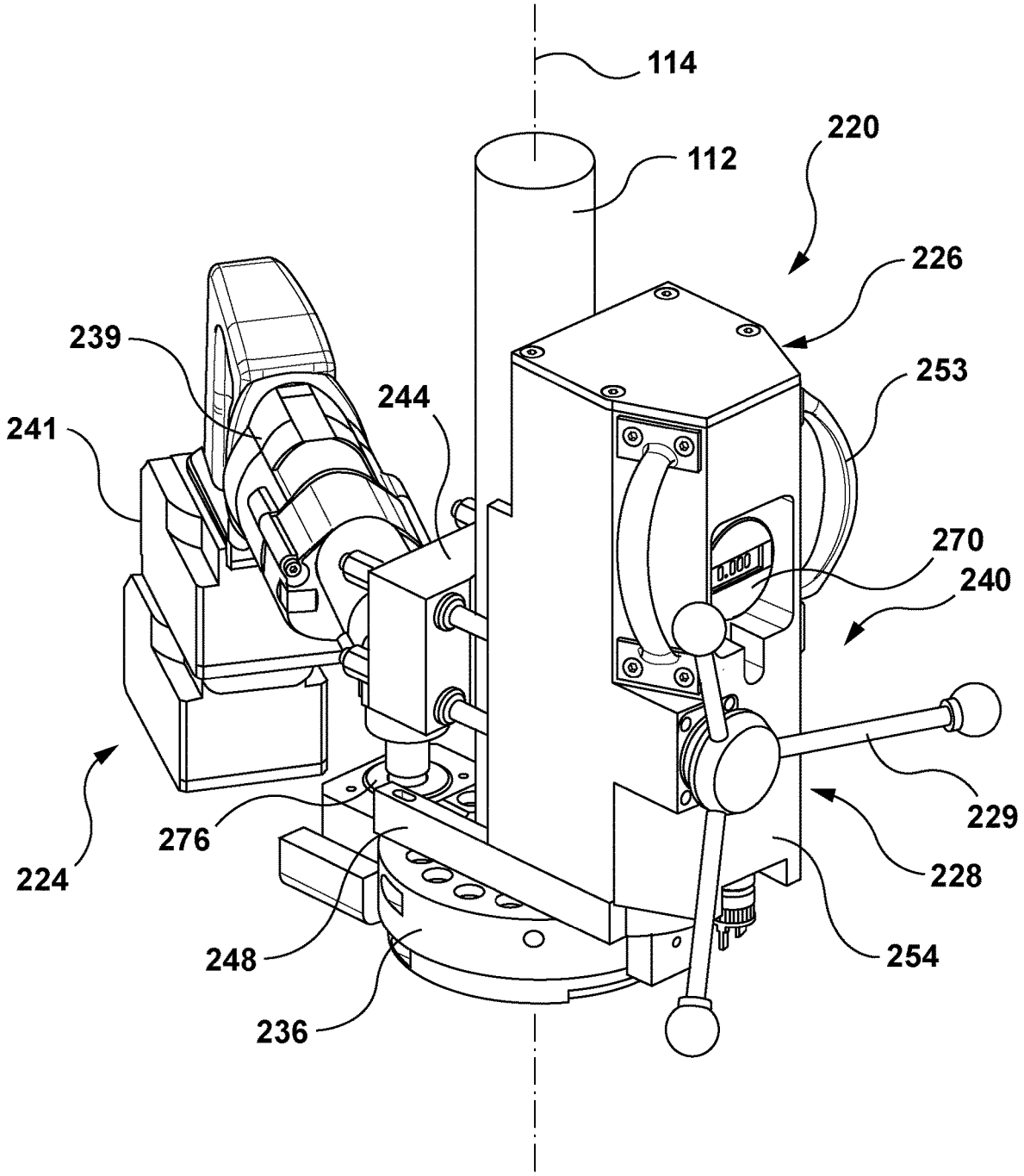
FIG. 14 is a perspective view of a drive apparatus secured to a stem of a valve assembly.

Referring to FIGS. 13 and 14, in the illustrated example the drive apparatus 220 is mounted to the valve stem 112 and includes a rotary drive 224, and an axial drive 226. In the illustrated example, the axial drive includes a manually actuatable hand crank 228, that a user can rotate to axially translate the rotary drive 224 and the honing tool 130 mounted thereto.

Referring to FIG. 14, in the illustrated example the drive apparatus 220 the rotary drive 224 includes a drive mechanism 236 that is configured to transfer motive power to the honing tool 130 disposed around the valve stem 112 and to cause the honing tool 130 to rotate about the stem axis 114 of the valve stem 112. The honing tool 130 may be coupled to the drive mechanism 236 for torque transmission via the collar 132.

Figure 17:
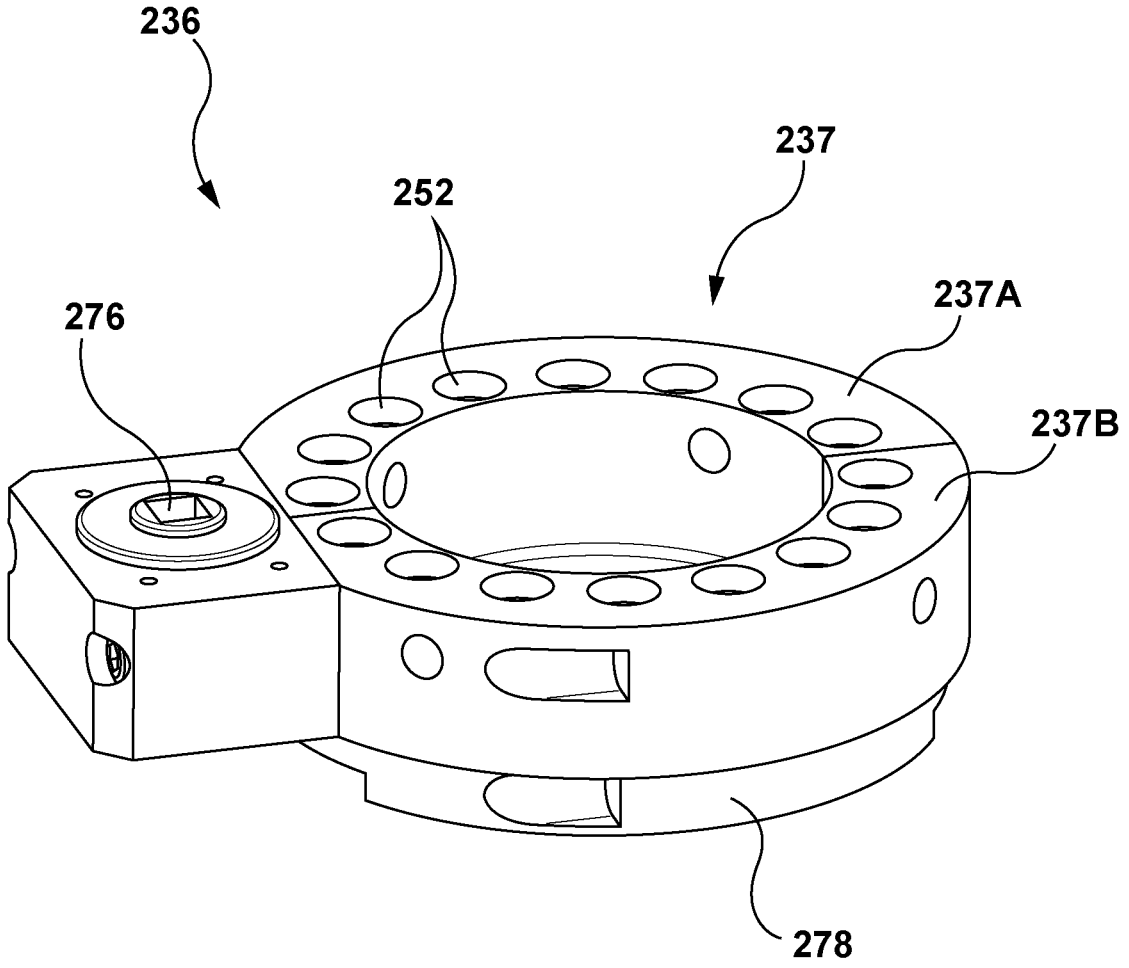
FIG. 17 is a perspective view of a portion of the drive apparatus of FIG. 14.
Figure 18:
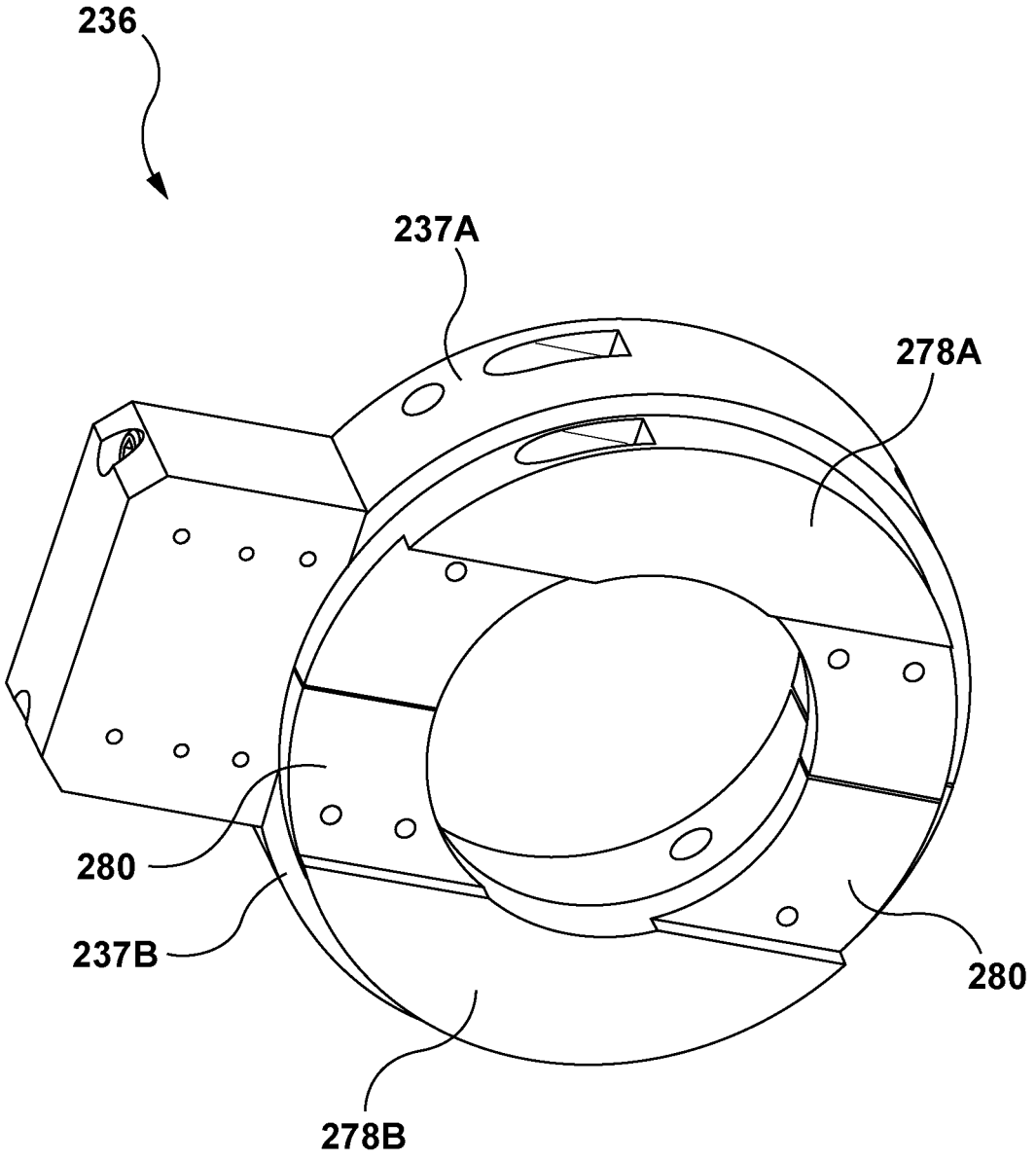
FIG. 18 is another perspective view of the portion of the drive apparatus of FIG. 17.

Referring to FIGS. 17 and 18, in the illustrated example, the drive mechanism 236 includes a split frame drive such as, for example, a small diameter split frame (SDSF) sold by E. H. Wachs. Accordingly, the drive mechanism 236 may include a mounting member in the form of have an openable frame 237 with two halves 237A and 237B that may be separated so as to help facilitate installation of the drive mechanism 236 around the valve stem 112 in situ. The halves 237A and 237B may be connected to each other using one or more suitable, releasable fasteners, such as bolts, screws, clamps and the like. The frame 237 can be used to fasten the drive apparatus 220 to the valve stem 112, and optionally can engage the stem 112 in a non-rotatable manner so that the lower end of the axial drive 226 does not rotate relative to the valve stem. In some embodiments, the frame 237 may form at least a portion of the mounting members that are used to help mount the drive apparatus 220 to the valve stem 112.

Referring also to FIG. 14, in the illustrated example, the rotary drive 224 includes an input 276 for receiving motive power from an external source such as the motor 239. The input 276 is mounted to the frame 237, and is rotatable relative to the frame 237. The rotary drive 224 also includes an output in the form of a ring 278 that is rotatably connected to the frame 237 and configured to rotate about the valve stem 112 upon the application of motive power to the input 276. Like the frame 237, the ring 278 can include two detachably connected halves 278*a* and 278*b* (FIG. 18) to help facilitate positioning the ring 278 around the valve stem 112 (FIG. 14). Accordingly, the ring 278 is drivingly connected to the input 276, for example using gears, drive belts and the like, so that the output 278 may transmit power applied to the input 276 to the honing tool 130.

Optionally, the honing tool 130 (or any other suitable tool) can be attached to the ring 278. In the illustrated example, the ring 278 includes slots (FIG. 18) slots 280, into which mounting flanges 135 (FIG. 3) on the collar 132 can be inserted. Alternatively, the collar 132 may be connected to the ring 278 using any suitable fastening mechanisms, including bolts, screws, clamps, welding, chemical adhesives and the like.

The drive mechanism 236 may be driven by any suitable an external source of motive power such as the motor 239. The motor 239 may, for example, comprise a pneumatic actuator or an electric motor. Optionally, the motor 239 may be configured to output rotary motion at a variable speed. Accordingly, the motor 239 and the output speed thereof may be configured to be operated/controlled by an operator of drive apparatus 220. In the illustrated example, the motor 239 is provided in the form of a battery-powered electric drill that is configured to output a rotary speed sufficient to rotate the honing tool 130 at a speed appropriate under the specific conditions. Under certain conditions, an appropriate speed of the honing tool 130 may be around 80 rpm for example. Battery(ies) 241 may be used to power motor 239. This may help facilitate the use of the motor 239 in the field (i.e. at the valve location), and in other locations where access to electrical power is limited or unavailable.

Figure 15:
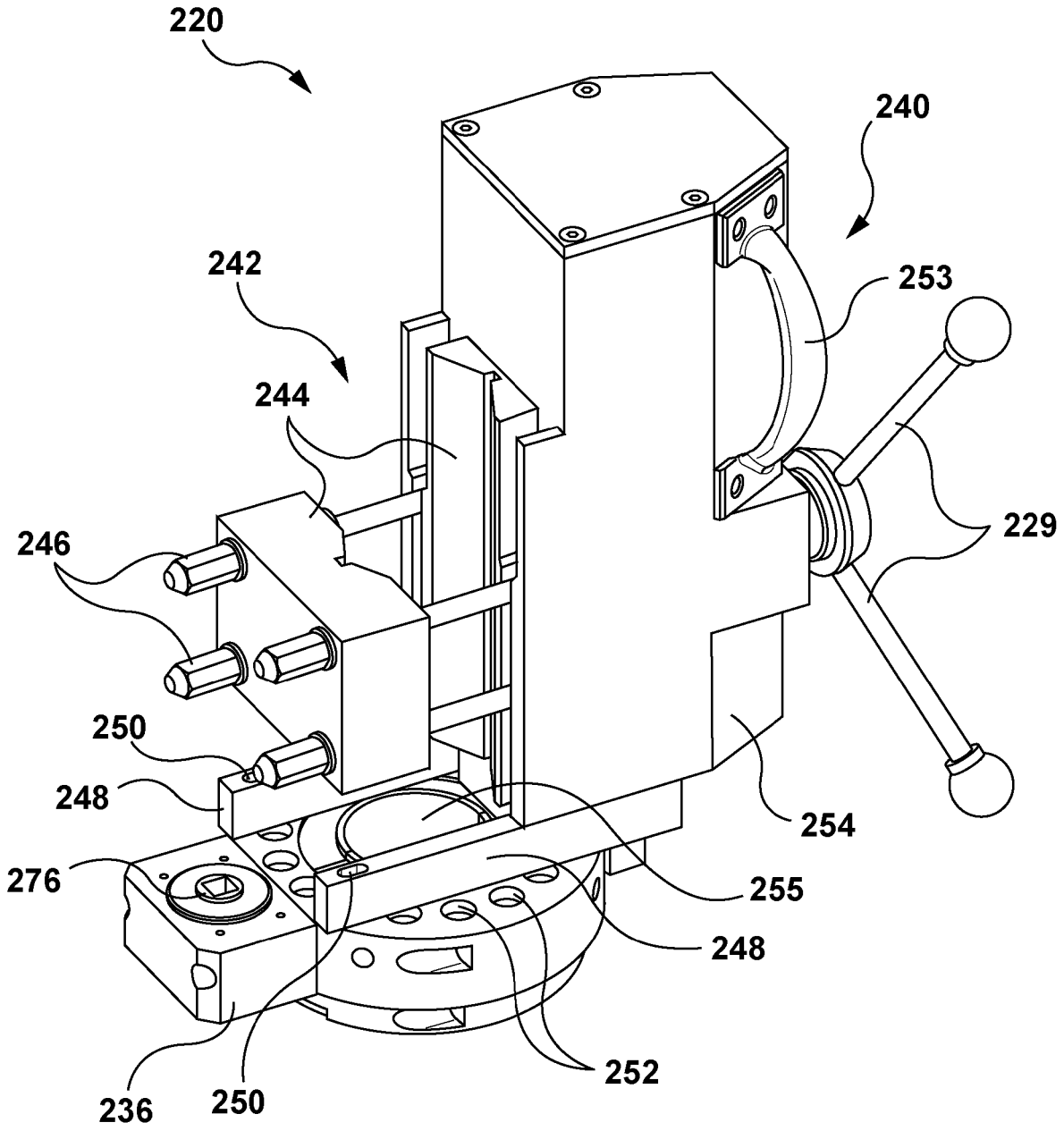
FIG. 15 is a perspective view of a portion of the drive apparatus of FIG. 14.
Figure 16:
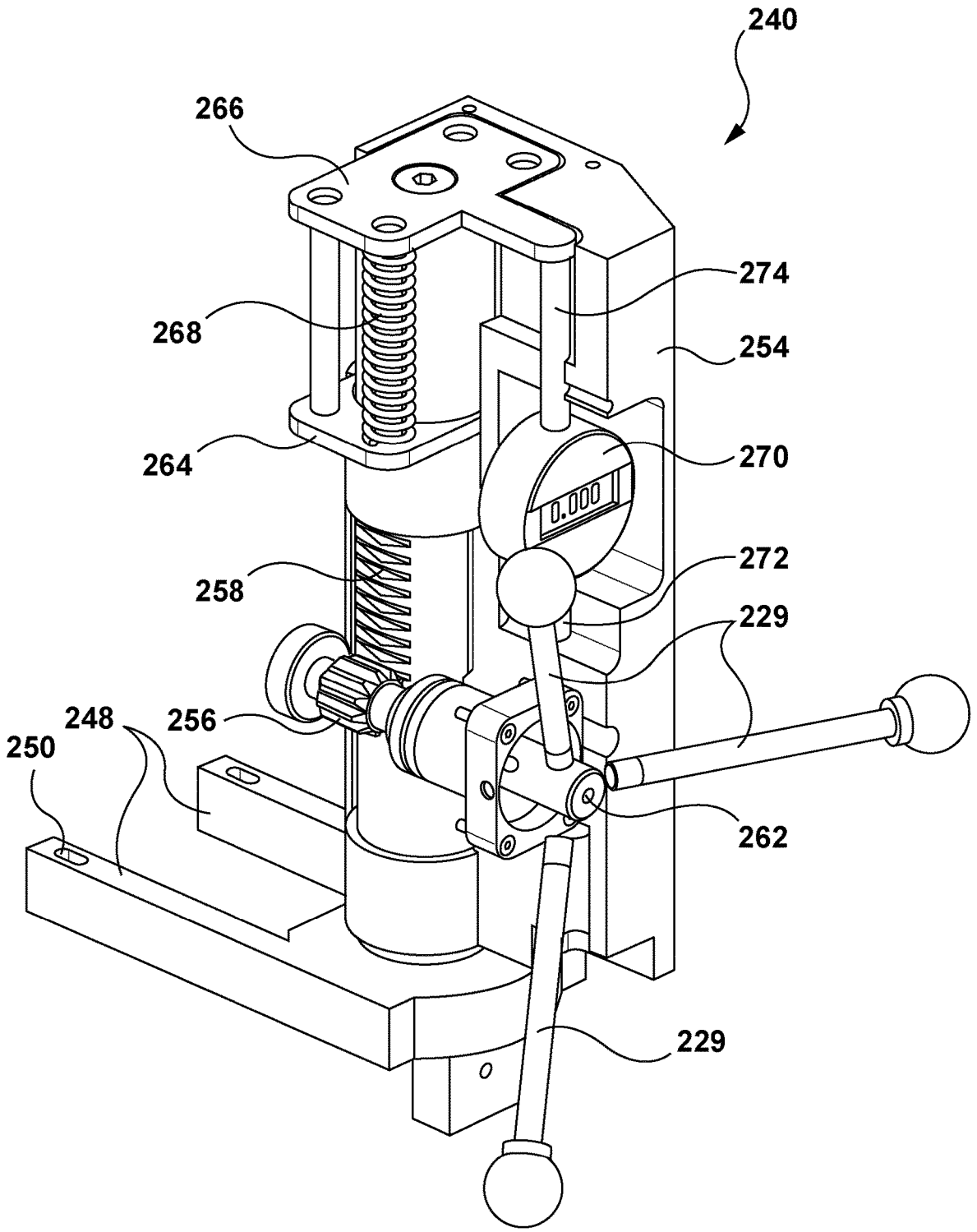
FIG. 16 is a perspective cutaway view of a feed mechanism portion of the drive apparatus of FIG. 14.

Referring to FIGS. 14-16, in the illustrated example the axial drive 226 includes an axial feed mechanism 240 that is configured to be removably secured to the valve stem 112 using the an openable frame 237. The feed mechanism 240 may be used to cause the honing tool 130 to translate axially along the stem axis 114 of the valve stem 112, and preferably the honing tool 130 can translate while it is rotating about the valve stem 112 (but alternatively, the axial translation may only occur then the honing tool 130 is not rotating).

Referring to FIG. 15, in the illustrated example the drive apparatus 220 includes an additional mounting member in the form of clamp(s) 242 that may be used to removably secure the feed mechanism 240 to the valve stem 112. The clamp(s) 242 may comprise one or more V-blocks 244 wherein one of the one or more V-blocks 244 may be movable/adjustable along a length of T-bolts 246. For example, two V-blocks 244, as shown in FIG. 15, may receive the valve stem 112 therebetween and be used to secure the feed mechanism 240 to the valve stem 112. The T-bolts 246 may be anchored inside a housing 254 of the feed assembly 240 and the spring-loaded T-bolts 246 may serve to tighten the V-blocks 244 onto the valve stem 112 when the valve stem 112 is disposed between the two V-blocks 244. The use of the V-blocks 244 and T-bolts 246 may also permit the feed mechanism 240 to be secured to valve stems 112 of different sizes (e.g. diameters) within a certain range. During assembly of the feed mechanism 240 onto valve stem 112, the T-bolts 246 may be tightened to a pre-determined torque value or to within a range of predetermined torque values to prevent overloading or otherwise damaging of the valve stem 112. Optionally, the clamps 242 may be the only mounting member used to engage the valve stem 112 (i.e. the frame 237 need not engage the valve stem 112 directly, but instead may be supported by the axial drive 226). Alternatively, the fame 237 and clamps 242 may co-operate to engage the valve stem 112 and support the drive apparatus 220. Preferably, the clamps 242, frame 237 and any other mounting members are releasable members, so that the drive apparatus 220 can be connected to a given valve stem 112 when required, and then disconnected to allow the valve to be returned to service and/or to allow the drive apparatus 220 to be used on another valve.

Optionally, the feed mechanism 240 may be coupled (e.g. secured) to the drive mechanism 236 via one or more fingers 248, which are optionally provided toward the lower end of the housing 254. The finger(s) 248 can translate axially relative to the rest of the housing 254, which may also translate the drive mechanism 236 and the honing tool 130 mounted thereto. For example, the finger(s) 248 may comprise one or more through holes 250 and the drive mechanism 236 may comprise corresponding one or more threaded holes 252. For example, the through hole(s) 250 and the threaded hole(s) 252 may serve to secure the finger(s) 248 to the drive mechanism 236 using one or more threaded fasteners (not shown). The through hole(s) 250 may be slotted so as to permit some adjustment of the position of the feed mechanism 240 relative to the drive mechanism 236 so as to, for example, adjust the position of the drive mechanism 236 relative to the valve stem 112 once the feed mechanism 240 has been secured to the valve stem 112. The feed mechanism 240 may be used to cause movement of the drive mechanism 236 along the stem axis 114 of the stem 112. Accordingly, the feed mechanism 240 may be used to cause the honing tool 130 to advance into and/or retract from the stuffing box while the honing tool 130 is rotating about the valve stem 112. Optionally, the feed mechanism 240 could be coupled to the drive mechanism 236 using other suitable means. The feed mechanism 240 may also comprise one or more carrying handles 253 secured to the housing 254.

Optionally, a protection sleeve(s) 255 may be inserted between the valve stem 112 and the drive mechanism 236 to provide protection of the valve stem 112 and also provide stability for the drive mechanism 236. The protection sleeve (s) 255 may, optionally, be split in two halves for ease of installation around the valve stem 112. The protection sleeve (s) 255 may comprise a low friction polymeric material. The protection sleeve(s) 255 may also extend between the honing tool 130 and the valve stem 112. For example, the protection sleeve(s) 255 may be made of acetal resin sold by DuPont™ under the trade name Delrin®.

Referring to FIG. 16, in the illustrated example the feed mechanism 240 is illustrated with a portion of the housing 254 cut away to reveal some of the internal components. In the illustrated example, the feed mechanism 240 includes a first gear 256 and a second gear 258 meshed to the first gear 256. The first gear 256 and second gear 258 may be configured to receive motive power from an external source, such as the handle 228, and cause the honing tool 130 to translate, via the finger(s) 248 and drive mechanism 236, along the stem axis 114 of the valve stem 112, optionally while the honing tool 130 is rotating about the valve stem 112. The first gear 256 may be any suitable gear, and in the illustrated example is provided in the form of a pinion gear. The second gear 258 may be any suitable type of gear, and in the example illustrated is provided in the form of a linear gear (e.g. rack) that can engage the pinion gear 256. The pinion gear 256 may be configured to receive a torque applied from an external source of motive power. The external source of motive power may include a motor which may, for example, be electrically, hydraulically, or pneumatically powered and used to effect rotation of the pinion gear 256. Alternatively, the external source of motive power may include an operator of the drive apparatus 220. Accordingly, one or more hand cranks 228 may be coupled to the pinion gear 256 to permit an operator to apply a torque to the pinion gear 256. The hand crank(s) 228 may include any desired number of spokes 229 extend radially from a hub 262 coupled to the pinion gear 256.

The rack 258 may be meshed with the pinion gear 256 and also coupled (e.g. secured) to the finger(s) 248. Accordingly, rotation of the pinion gear 256 may cause linear displacement of the rack 258 substantially along the stem axis 114 of the valve stem 112. Linear displacement/translation of the rack 258 may consequently be transferred to the drive mechanism 236 via the finger(s) 248 to thereby cause advancement and/or retraction of the honing tool 130 into and out of the stuffing box. The rack 258 may comprise a sufficient number of teeth and be of sufficient length to permit advancement of the honing tool 130 by a desired amount without needing to unclamp and re-clamp the feed mechanism 240 to the valve stem 112 in order to achieve the desired amount of advancement of the honing tool 130. The desired amount of advancement of the honing tool 130 may be enough to allow the honing pads 156 to engage the entire axial length 124 of the inner surface 104 of the stuffing box.

Optionally, the feed mechanism 240 may include an actuator (such as a motor, a biasing member or the like) to cause automatic retraction of the honing tool 130 away from the stuffing box when torque applied to the pinion gear 256 is either significantly reduced or is no longer applied to the pinion gear 256. Accordingly, the feed mechanism 240 may comprise a stationary plate 264, moving plate 266 and spring(s) 268 coupled to the stationary plate 264 and moving plate 266. The stationary plate 264 may be stationary relative to the movement of the rack 258. The moving plate 266 may be secured to the rack 258 so that the moving plate 266 may move together with the rack 258 when torque is applied to the pinion gear 256. The spring(s) 268 may be biased to push the moving plate 266 away from the stationary plate 264. A position where the finger(s) 248 and housing 254 are in contact with each other may be considered a "zero" or "home" position prior to any advancement of the rack 258 and/or the honing tool 130.

The feed mechanism 240 may also include any suitable type of indicator that can show a user the axial position of the drive apparatus 220 (and any tools mounted thereon). This may help a user determine where a tool is relative to the stuffing box 102. For example, the indicator may include a distance measurement device, having an indicator 270, which may provide an indication of the linear displacement of the rack 258 relative to the housing 254 and accordingly provide an indication of advancement of the honing tool 130. Support 272 may secure the indicator 270 to the housing 254 and the probe 274 may be resiliently biased against the moving plate 266 so as to measure relative displacement between the housing 254 and moving plate 266.

When in use, and once stuffing box 102 has been partially disassembled, the honing tool 130 may be installed around the valve stem 112 so that honing pads 156 may be adjacent to the valve stem 112. The drive mechanism 236 may be installed around the valve stem 112 as shown in FIG. 14 so that the base portions 182 and 184 (FIG. 3) may be disposed in corresponding slot(s) 280 (FIG. 18) to permit torque transmission between the drive mechanism 236 and the honing tool 130. Clamp(s) 242 may be used to secure the feed mechanism 240 to the valve stem 112. The drive mechanism 236 may then be positioned/adjusted if necessary and secured to the finger(s) 248.

Once installed on the valve stem 112, the drive apparatus 220 may be used to move the honing tool 130. Rotation of the honing tool 130 may be achieved by using motor 239 or other suitable source of motive power coupled to input 276 of the drive mechanism 236. While the honing tool 130 is rotating, the honing tool 130 may be translated along the valve stem axis 114 by applying a force to the hand crank 228 (FIGS. 15-16) in order to transmit a torque to the pinion gear 256 and thereby cause the pinion gear 256 to rotate. Rotation of the pinion gear 256 may consequently cause linear displacement of the rack 258, which may be transferred to the drive mechanism 236 and the honing tool 130 via the finger(s) 248.

The use of a manual feed mechanism, such as the feed mechanism 240 may provide an operator with a mechanical advantage and relatively good control over the advancing force applied to the honing tool 130 and thereby facilitate the application of a substantially constant force by the operator.

Simultaneously, the operator may also control the speed of the motor 239 to control the speed of the honing tool 130 while monitoring the cutting rate and depth of the honing tool 130 by monitoring the micrometer 270. Accordingly, the feed mechanism 240 and drive mechanism 236 may permit relatively good control of the honing tool 130.

Upon the operator releasing the hand crank 228 in order to cease the application of torque to the pinion gear 256 and spring 268 may automatically cause retraction of the rack 258 towards the home position and thereby cause retraction of the drive mechanism 236 and the honing tool 130 away from the stuffing box. That is, the axial drive 226 can be biased toward its retracted position, i.e. away from the stuffing box, so that tools are automatically moved away from the stuffing box when a user releases the hand crank.

Protective Cover

Optionally, the honing tool 130 may be provided with a protective cover to help protect portions of the valve stem 112 or stuffing box 102 from unwanted contact or damage when the honing tool is in use. For example, if the honing tool 130 is being used to hone the inner surface 104 of the stuffing box 102 a user may wish to protect the outer surface 116 of the valve stem 112 so that it is not unintentionally damaged. In some embodiments, the protective cover may be positioned over the surface to be protected (i.e. around the valve stem) prior to positioning the collar 132, so that the protective cover is disposed radially between the honing pads and the valve stem. In such embodiments, the protective cover may remain stationary when the collar 132 moves and may or may not be coupled to the collar.

Alternatively, or in addition to such stationary protective covers, the protective cover may be attached to the collar 132 (or any other suitable portion) such that the protective cover moves with the collar 132 relative to the surface being protected. For example, the protective cover may be configured as a generally elongate sleeve that extends along the length of the valve stem, but is supported by the collar such that it does not actually contact the valve stem. When the collar rotates the protective sleeve can also rotate relative to the valve stem, while still inhibiting contact between the valve stem and the arms and honing pads.

Referring to FIGS. 3 and 12, in the illustrated embodiment the honing tool 130 includes a protective cover 227 that extends axially from the collar 132 and forms part of the central apertures 136 to receive the valve stem 112. In this configuration, at least a portion of the protective cover 227 is positioned radially between the valve stem 112 and the honing pads 156, but remains radially spaced apart from the valve stem 112 by a radial cover spacing distance.

In the illustrated example the protective cover 227 is rotatable with the collar 132 about the collar axis 138, relative to the valve stem 112.

Optionally, if the collar 132 is an openable collar, as illustrated, the protective cover 227 may also be configured to be openable to help facilitate installing the protective cover 227 around the valve stem 112, and its subsequent removal. The protective cover 227 may have any suitable configuration that allows it to be laterally positioned around the valve stem. Referring to FIG. 10, in the illustrated embodiment, the protective cover 227 is formed from a first cover portion 230, that is connected to the first collar portion 182, and a second collar portion 232 that is connected to the second collar portion 184. Configuring the protective cover 227 to include at least two portions 230 and 232 may help facilitate opening the protective cover 227. Alternatively, the protective cover 227 need not be openable, and may be slid axially over a free end of the valve stem, or installed in any other suitable manner. For example, the protective cover may be provided in the form of a wrap or tape-like member that can be wrapped or coiled around the valve stem.

Optionally, the first and second cover portions 230 and 232 may be connected directly to each other to hold the protective cover in its closed position around the valve stem. Alternatively, the first and second cover portions 230 and 232 may only be connected to the base portions 182 and 184 and need not directly fastened to each other.

While illustrated as surrounding the entire surface of the valve stem 112, in other examples the protective cover 227 may only cover a portion of the valve stem 112. For example, the protective cover 227 may include one or more portions that are positioned behind respective ones of the support arms 148 and honing pads 156, while leaving the region between the arms 184 free from the protective cover. This may help reduce the size and weight of the protective cover 227 while still positioning portions of the cover 227 between the honing pads 156 and the valve stem surface 116.

While showing having four support arms 148, in other embodiments the honing tool 130 may have fewer than four arms (e.g. three arms, two arms or one arm) or more than four arms.

Optionally, the support arms 148 may be generally equally spaced apart from each other around the periphery of collar 132. Arranging the arms in a generally equally spaced configuration may help balance the radial loads exerted on the body, and may help the honing tool to remain axially aligned when in use. Alternatively, the arms may be unequally spaced from each other.

In the illustrated embodiment the honing pads 156 are generally radially outward facing and are configured to engage and treat the inward facing surface 104 of the stuffing box 102. Alternatively, the honing pads 156 may be reversed so that they are generally inwardly facing and may be biased inwardly to engage and treat the outer surface 116 of the valve stem 112. In yet another alternative embodiment, the honing pads may have two, opposing honing surfaces (one facing inward and one facing outward) and may be sized to substantially fill the radial distance 120 so that the honing tool can engage and treat the surfaces 116 and 104 of the valve stem 112 and stuffing box 102 simultaneously.

In the illustrated embodiment the honing pads 156 are pivotally coupled to the arms 148. This may help facilitate alignment of the honing pads 156 with the surface being treated. In other embodiments, the honing pads 156 may be non-rotatably coupled to the arms 148.

Optionally, whether or not the honing pads are rotatably or non-rotatably coupled to the arms, one or more of the arms 148 may be configured so that the distal portion 152 of the arm 148 is movable relative to other portions of the arm 148. For example, the arm 148 may include a pivot joint, or may be resiliently flexible or the like to help facilitate alignment of the honing pads 156 relative to the surface being treated.

In the illustrated embodiment, the honing pads 156 are retained between a pair of opposing fingers 194*a* and 194*b* at the end of the arm 148. Providing two, spaced apart fingers 194*a* and 194*b* may help facilitate a balanced and sufficiently strong connection between the honing pad 156 and the arm 148 to resist the expected radial, axial and circumferential loads that will be exerted on the honing pad 156 in use. Alternatively, one or more of the arms may only include a single finger, or other suitable point of attachment between the honing pad and the arm. In such a configuration, the honing pad 156 may be cantilevered, but may still have sufficient structure support to be used in some surface treating applications. Providing only a single finger member, or simply connecting the honing pad 156 to a side surface of the arm 148, may help simplify the design of the arm 148 and may reduce the cost of manufacturing the honing tool 130.

Optionally, the arms 148 may be detachably connected to the collar 132. Providing detachably mounted arms may help facilitate assembly of the honing tool. Providing detachable arms may also help facilitate repair of the honing tool by allowing the replacement of a damaged arm with a replacement arm, without requiring replacement of the collar and other components of the honing tool. This may also help facilitate the use of one collar with a plurality of different sets or types of arms (possibly having different configurations for different applications) or vice versa (a common set of arms may be connectable to a variety of different collar portions configured to fit different valve stems). Alternatively, some or all of the arms 148 may be integrally formed with the collar 132.

Suction System

Optionally, the honing tool apparatus can include a suction or vacuum system to capture at least some of the debris that is generated during the surface treating process. Capturing the debris from the surface treating process may help reduce the likelihood of debris falling into the stuffing box or otherwise fouling or damaging the stuffing box and/or valve stem. Using the suction apparats while the honing tool 130 is in use may help suck up the debris as it is being generated, before it has a chance to fall into the stuffing box. Suctioning the debris simultaneously with operating the honing tool 130 may help reduce the need to perform a separate cleaning after completing the honing. Capturing the generated debris may also be helpful when the surface treating is performed in situ, as compared to conventional situations where the valve is removed from service prior to treating, as it may help reduce the overall service time, and may help reduce the need to further disassemble the valve for cleaning when the surface treating is complete.

Optionally, the suction apparatus can have a nozzle that is fluidly connected to a suction source, such as a vacuum cleaner, plant suction and the like. The nozzle can be positionable proximate the surface treating member to extract from the bore debris as it is being generated by engagement between the surface treating member and the inner surface of the bore. In some configurations, the nozzle may be of a generally annular or ring-like configuration in which the nozzle can at least partially (and optionally entirely) surround the valve stem. For example, the nozzle can be configured as a ring that is placed in close proximity to the open upper end of the stuffing box.

Optionally, the nozzle can include at least two portions that are detachable connected to each other, so that the nozzle can be configured in a closed configuration, in which it can encircle the shaft, and an open configuration, in which it can laterally receive the shaft.

Optionally, the nozzle may be configured to provide suction along substantially the entire extent of its circumference, and in some configurations may provide suction around its entire circumference. This may help capture debris generated at different locations around the perimeter of the stuffing box.

The nozzle can be connected to the suction source using any suitable mechanism, including, for example, a hose or other flexible conduit.

Optionally, the nozzle need not be rotatable relative to the valve stem, and remain generally fixed as the honing tool is rotated. Alternatively, some or all of the nozzle may be rotatable relative to the valve stem.

Optionally, the nozzle need not be translatable relative to the valve stem, and remain generally fixed as the honing tool is translated axially. Alternatively, some or all of the nozzle may be translatable relative to the valve stem.

Method of Honing an Inner Surface of a Valve Stuffing Box

When using a surface treating tool that includes one or more of the aspects described herein, a method of honing an inner surface of a bore in a valve body (such as a stuffing box 102) containing a valve stem 112 may include the step of positioning a collar 132 around a valve stem 112 so that the collar 132 can move relative to the valve stem 112 about a collar axis 138. The method may also include inserting a distal end 152 of a support arm 148 into an annular volume 118 formed between an outer surface 116 of the valve stem 112 and an inner surface 104 of a bore 102. With the pad in position, the method can then include pressing a honing pad 156 against the inner surface 104, and the method can also include moving the honing pad 156 relative to the surface 104. This movement may optionally include rotating the collar 132 relative to the valve stem 112, and/or translating the collar 132 and honing pad 156 along the valve stem 112, whereby the honing pad 156 travels across the inner surface 104.

Optionally, to position the collar 132 around the valve stem 112 the method can include the steps of opening the collar 132 to laterally receive the valve stem 112 and closing the collar 132 around the valve stem 112.

Preferably, the method can include biasing the honing pad 156 against the inner surface of the bore using a biasing member. Optionally, the biasing may be achieved by biasing a proximal end 150 of the support arm 148 inwardly toward the collar axis 138, and thereby pivoting the arm 148 about a pivot coupling such that the distal end 152 of the arm 148 is urged outwardly away from the collar axis 138.

With the honing tool 130 in position, a driving apparatus 220 can be used to move the collar 132, and optionally the method can include the step of attaching the driving apparatus 220 to at the valve stem 112.

Preferably, using this method the honing of the stuffing box surface 104 can be performed in situ, i.e. without detaching the valve from its adjacent pipes or transporting the valve to an offsite workshop.

Preferably, when carrying out this method the treating of the surface is achieved while maintaining a radial gap between the distal end 152 of the support arm 148 and the valve stem 112. This gap may help prevent damage to the valve stem 112, and optionally the protective cover 227 may also be positioned radially between the support arm 148 and the valve stem 112.

More generally, surface treating tools may also be used to on objects other than valves, for example to treat the inner surface of any suitable bore that contains a shaft (or other similar object or obstacle disposed within the bore). Such a method may include the step of inserting a first end of a support arm into an annular volume formed between an outer surface of the shaft and an inner surface of a bore, where the one end of the support arm supports a surface treating pad.

The method can also include the steps of pressing the surface treating pad against the inner surface and moving the surface treating pad across the inner surface. Optionally, these steps can be performed simultaneously, and may be performed while maintaining a radial gap between the surface treating pad and the shaft.

The movement operations can include at least one of rotating the surface treating pad about the shaft and translating the surface treating pad along the shaft, and optionally both types of movement may be performed simultaneously.

To help position the surface treating tool, the method may include the step of positioning a collar around the shaft so that the collar can rotate relative to the shaft wherein the support arm is connected to the collar and is movable with the collar relative to the shaft. Optionally, the collar can be openable or otherwise configured such that this step includes laterally positioning the collar around the shaft.

Optionally, prior to using the honing tool 130, a user may use a packing removal tool to help remove the packing material 106 from the stuffing box 102. The packing removal tool may be any suitable tool that can fit within the stuffing box 102 to engage the packing material 106, preferably, without having to remove the valve stem 112. If the packing material 106 can be cut out without having to remove the valve stem 112, and the honing tool 130 is used to treat the surfaces without needing to remove the valve stem 112, it may help facilitate an overall service/repair of the valve in situ.

Figure 19:
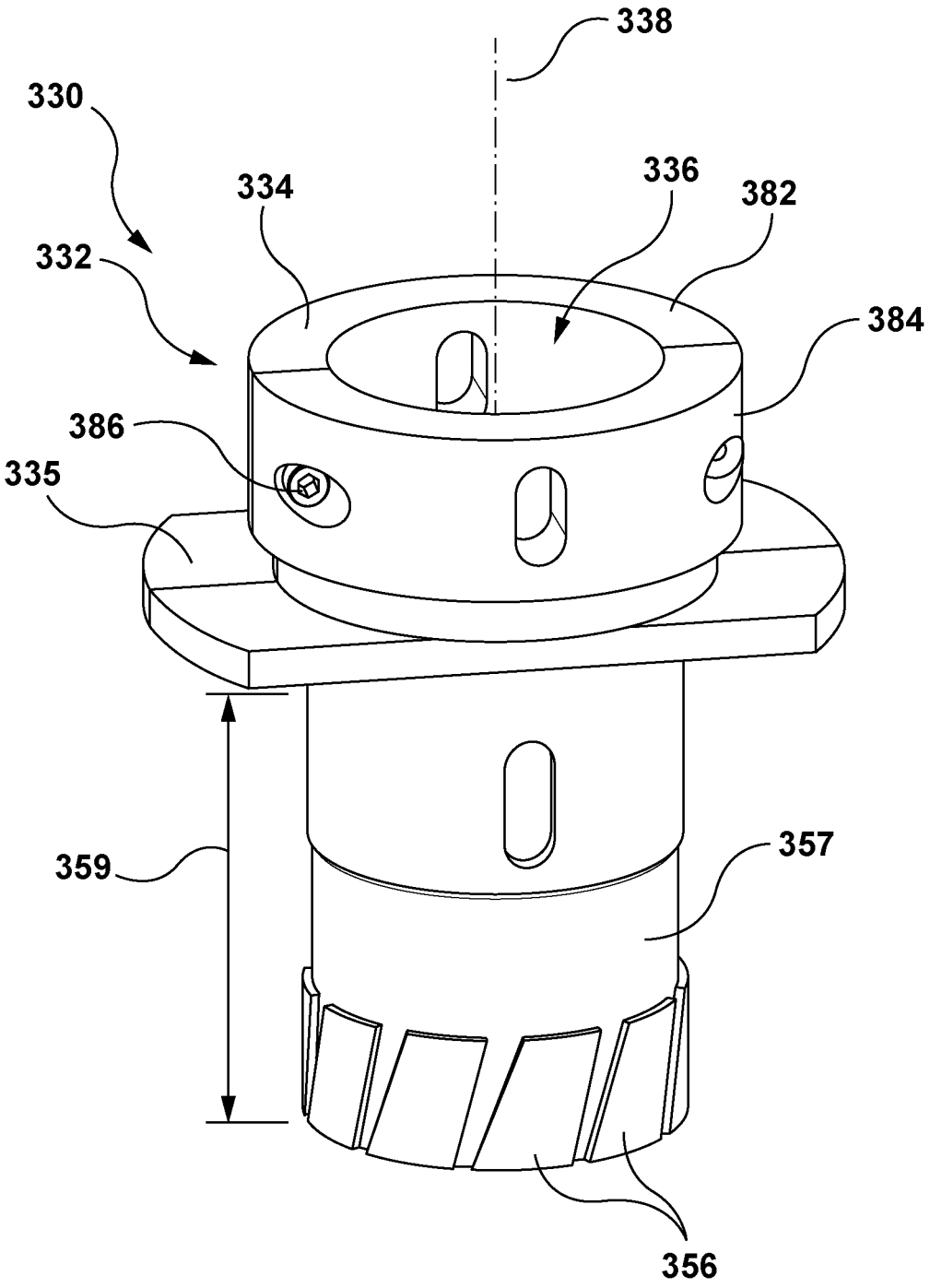
FIG. 19 is a perspective view of one example of a cutting tool.

Referring to FIG. 19, one example of a suitable packing removal tool, in the form of a cutting tool 330, is configured to be positioned around the valve stem 112 and to be both rotated and axially translated relative to the valve stem 112. Optionally, as illustrated, the cutting tool 330 can be configured to be connected to and driven by the same drive apparatus 220 that can be used to drive the honing tool 130. Optionally, the honing tool 130 and cutting tool 330 can be provided as alternative tools or bits that can be interchangeably connected to the drive apparatus 220, along with one or more other suitable tools.

In the illustrated example, the cutting tool 330 includes a body in the form of a collar 332 and a cutting member that includes a plurality of cutting teeth 356 that are connected to the collar 332. A spacer member, such as the elongate cylindrical spacer 357 can be provided to help axially space the teeth 356 from the collar 332. This may help facilitate inserting the teeth 356, and optionally portions of the spacer 357, into the interior of the stuffing box 102 and/or into other regions that are too narrow to receive the collar 332. Optionally, the length 359 of the spacer 357 can be selected so that the teeth 356 can be positioned toward the bottom of the stuffing box 102 without the collar 332 contacting the upper end of the stuffing box 102. For example, the length 359 may be between about 10 mm and about 250 mm or more, and may be between about 20 mm and about 100 mm.

The collar 332 includes a base portion 334 that surrounds a central aperture 336. The aperture 336 extends along a collar axis 338 and is sized to loosely fit around the columnar shaft portion of the valve stem 112 (FIG. 2).

When the collar 332 is positioned around the valve stem 112, the valve stem 112 extends through the aperture 136 and the collar axis 138 is substantially coaxial with the collar axis 114 (FIG. 1). The collar 332 is configured so that it can move relative to the valve stem 112, and optionally can be configured to rotate relative to the valve stem (about the collar axis 338), translate axially relative to the valve stem, or both. Optionally, the collar 332 may be simultaneously rotated and translated relative to the valve stem 112.

Optionally, the cutting tool 330 can be openable (for example, in a manner analogous to the honing tool 130) to help facilitate laterally positioning the cutting tool 330 around the valve stem 112. In the illustrated example, the base portion 334 includes a first base portion 382 and a second base portion 384 that is detachably connected to the first base portion 382 using threaded fasteners 386. To position the cutting tool 330, the base portions 382 and 384 can be separated from each other (i.e. to open the base 334) and the cutting tool 330 can be laterally maneuvered around the valve stem 112. The portions 382 and 384 can then be re-attached to each other to close the base 334 around the valve stem 112.

The cutting tool 330 can be connected to the drive apparatus 220 using any suitable mechanism, and in the illustrated example includes the ring 278 includes slots (FIG. 18) slots 280, into which mounting flanges 335 on the collar 332 for inserting into the corresponding slots 280 on the ring 278 (FIG. 18) of the drive apparatus 220.

When in use, the cutting tool 330 can be positioned above the stuffing box 102 of a valve, and can then be translated downwardly while rotating about the valve stem 112 so that the cutting teeth 356 can engage the packing material 106. Optionally, the cutting tool 330 can be used to cut through all, or at least substantially all of the packing material 106. Alternatively, the cutting tool 330 can be used to cut portions of the packing material 106 (for example, damaged and/or corroded portions) and then retracted out of the stuffing box 102. Remaining portions of the packing material 106 may then be removed using other means, such as manually gripping and extracting the packing material 106.

Optionally, in some circumstances, it may be appropriate and/or desirable to isolate the valve being serviced from any fluid transfer system or network to which it is connected (i.e. to take the valve out of service). For example, a by-pass line may optionally be used to isolate the valve from pressurized fluid flows while removing the packing material 106 and treating the stuffing box 102. Alternatively, the valve may be moved into a closed position to contain the pressurized fluid, without requiring a by-pass line. While the fluid flows may be by-passed (for example to help reduce leakage when the packing material 106 is removed), the tools and methods described herein may be used to service the valve without requiring that it be physically disconnected or removed from the piping network.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface treating apparatus for treating an inner surface of a bore containing a shaft, the apparatus comprising:

a) a body connectable to a drive apparatus and configured to movably and laterally receive a shaft extending through a bore;

b) at least one surface treating member connected to and movable with the body relative to the shaft, the at least one surface treating member sized to be inserted within an annular gap formed between the shaft and an inner surface of the bore and to bear against the inner surface of the bore when the shaft is received by the body.

2. The apparatus of claim 1, wherein the body comprises a collar having a collar aperture extending along a collar axis and sized to movably receive the shaft.

3. The apparatus of claim 2, wherein the collar is configurable between a closed configuration, in which the aperture completely encircles the shaft, and an open position, in which the aperture is open to laterally receive the shaft.

4. The apparatus of claim 3, wherein the collar comprises at least a first base portion and a second base portion that is detachably connected to the first base portion, and wherein detaching the second base portion from the first base portion opens the aperture to laterally receive, the shaft.

5. The apparatus of claim 2, wherein the collar aperture has a diameter in a lateral direction that is generally orthogonal to the collar axis and a thickness of the surface treating member in the lateral direction is between about 5% and 30% of the diameter.

6. The apparatus of claim 1, further comprising at least one support member connected to the body and having a first end that is axially spaced apart from the body and is positionabie within the annular gap formed between the shaft and the inner surface of the bore, and wherein the at least one surface treating member is mounted to the first end of the at least one support member.

7. The apparatus of claim 6, wherein the body has a body axis and when the shaft is received by the body the body axis is parallel to the shaft and the first end of the support member is biased laterally outwardly away from the body axis.

8. The apparatus of claim 6, wherein the first end of the support member comprises a first finger, a second finger spaced apart from the first finger around a perimeter of the body and the surface treating pad is disposed between and is movable relative to the first finger and second finger.

9. The apparatus of claim 8, further comprising a surface treating member support pivotally coupled to the first end of the support member, wherein the surface treating member is mounted to the pad support.

10. The apparatus of claim 9, wherein the surface treating member support pivots about a pivot axis that intersects the surface treating member and the first and second fingers.

11. The apparatus of claim 6, wherein the support member comprises a second end axially spaced apart from the first end and is pivotally connected to body by a pivot joint that is disposed axially between the first end and second end of the support member.

12. The apparatus of claim 11, further comprising a biasing member engaging the second end and biasing the second end laterally inwardly, whereby the first end is urged laterally outwardly.

13. The apparatus of claim 12, wherein the at least one support member comprises first, and second support arms coupled to the body and spaced apart from each other around a perimeter of the body, and each comprising respective first ends, second ends and pivot joints.

14. The apparatus of claim 13, wherein the biasing member comprises a spring that extends around a perimeter of the body and engages the second end of each of the first and second support arms.

15. The apparatus of claim 6, wherein the at least one support member comprises first, second, third and fourth support arms coupled to the body and spaced apart from each other around a perimeter of the body.

16. The apparatus of claim 1, further comprising a drive apparatus connectable to the body and comprising a rotary drive to rotate the body about a body axis and an axial drive to translate the body, the at least one support arm and the surface treating pad axially along the body axis relative to the shaft, whereby the body rotates about the shaft and the surface treating member is moved across the inner surface of the bore, and the axial drive and rotary drive are operable simultaneously with each other.

17. The apparatus of claim 1, wherein the surface treating member has a thickness in a lateral direction that is less than about 5 mm.

18. The apparatus of claim 1, further comprising a protective sleeve extending axially along the body axis and having a central aperture to movably receive the shaft, the protective sleeve positionable radially between the shaft and the surface treating member to prevent contact between the surface treating member and the shaft and being rotatable with the surface treating member relative to the shaft.

19. The apparatus of claim 1, further comprising a suction apparatus having a nozzle fluidly connected to a suction source and positionable proximate the surface treating member to extract from the bore debris generated by engagement between the surface treating member and the inner surface of the bore, the nozzle being configurable in a closed configuration, in which it can encircle the shaft, and an open configuration, in which it can laterally receive the shaft.

20. An apparatus to service a valve having a valve stem and a stuffing box in situ, the apparatus comprising:

a. a drive apparatus releasably mountable to the valve stem to support the apparatus; and b. at least one of i. a cutting tool connectable to the drive apparatus and having a body configured to movably receive the valve stem and at least one cutting member connected to and movable with the body relative to the valve stem, the at least one cutting member sized to be inserted within an annular gap formed between an outer surface of the valve stem and an opposing inner surface of the stuffing box, when the cutting tool is connected to the drive apparatus, the drive apparatus is operable to rotate the cutting tool about the valve stem and to translate the cutting tool along the valve stem to cause the at least one cutting member to translate axially into engagement with packing material disposed within the annular gap while the cutting tool is rotating about the tool axis, thereby cutting the packing material; and ii. a surface treating tool connectable to the drive apparatus and having a body configured to movably receive the valve stem and at least one surface treating member connected to and movable with the body relative to the valve stem, the at least one surface treating member sized to be inserted within the annular gap, and when the surface treating tool is connected to the drive apparatus and the packing material has been removed, the drive apparatus is operable to translate the surface treating tool along the valve stem to cause the at least one surface treating member to translate axially into the annular gap and to bear against the inner surface of the stuffing box and to rotate the surface treating tool about the valve stem to move the surface treating member around the inner surface of the stuffing box to treat the inner surface of the stuffing box.

* * * * *